US011925258B2

(12) United States Patent
Chakraborthy et al.

(10) Patent No.: US 11,925,258 B2
(45) Date of Patent: Mar. 12, 2024

(54) WELDLESS SHELF SUPPORT BEAMS AND SHELVING UNITS UTILIZING SAME

(71) Applicant: Edsal Manufacturing Company, LLC, Chicago, IL (US)

(72) Inventors: Anusha Chakraborthy, Bolingbrook, IL (US); Mitchell E. Bianchin, Villa Park, IL (US); Rohan Parab, Chicago, IL (US)

(73) Assignee: Edsal Manufacturing Company, LLC, Chicago, IL (US)

( * ) Notice: Subject to any disclaimer, the term of this patent is extended or adjusted under 35 U.S.C. 154(b) by 0 days.

(21) Appl. No.: 17/972,683

(22) Filed: Oct. 25, 2022

(65) Prior Publication Data

US 2023/0129296 A1 Apr. 27, 2023

Related U.S. Application Data

(60) Provisional application No. 63/315,744, filed on Mar. 2, 2022, provisional application No. 63/272,385, filed on Oct. 27, 2021.

(51) Int. Cl.
*A47B 57/50* (2006.01)
*A47B 47/00* (2006.01)
(Continued)

(52) U.S. Cl.
CPC ..... *A47B 57/50* (2013.01); *A47B 47/0083* (2013.01); *A47B 57/40* (2013.01); *A47B 96/07* (2013.01)

(58) Field of Classification Search
CPC ..... A47B 57/50; A47B 96/07; A47B 57/34; A47B 57/40; A47B 57/402; A47B 57/48;
(Continued)

(56) References Cited

U.S. PATENT DOCUMENTS 2,909,289 A 10/1959 Laurie
3,048,245 A 8/1962 Shewell
(Continued)

FOREIGN PATENT DOCUMENTS

CN 104665276 A 6/2015
CN 204410077 U 6/2015
(Continued)

OTHER PUBLICATIONS

Dahlstrom u-channel, www.dahlstromrollform.com <http://www.dahlstromrollform.com> [online]. Published on or before Sep. 24, 2020, [retrieved on Sep. 24, 2020]. Retrieved from the Internet: <URL :<https://www.dahlstronnrollfornn.conn/wp-content/uploads/2019/05/u-channel.pdf» (Year: 2020).
(Continued)

*Primary Examiner* — Jennifer E. Novosad
(74) *Attorney, Agent, or Firm* — Wood Herron & Evans LLP

(57) ABSTRACT

A shelf support beam for use in a shelving unit to support a shelf. The support beam includes a first end and a second end located at opposite longitudinal ends of the shelf support beam between which a structural member extends. The structural member has a C-shaped cross-section and includes a web separating a top flange that is configured to support the shelf from a bottom flange. The support beam further includes a tab located at each of the first and second ends of the structural member. Each tab includes a pair of securing fingers that are angled relative to a plane disposed perpendicular to a longitudinal axis of the shelf support beam such that each securing finger is angled inwardly toward a center of the structural member. The support beam further includes an enforcement tab formed in the web at each of the first and second ends of the structural member.

20 Claims, 29 Drawing Sheets

(51) Int. Cl.
*A47B 57/40* (2006.01)
*A47B 96/07* (2006.01)

(58) Field of Classification Search
CPC ..... A47B 57/16; A47B 57/20; A47B 57/22; A47B 47/0083; A47B 96/1408; A47B 57/406; A47B 57/482; A47B 47/028
USPC ..... 211/134, 192
See application file for complete search history.

(56) References Cited

U.S. PATENT DOCUMENTS 3,194,408 A * 7/1965 Kimpton ..... A47B 57/402 211/183
3,208,778 A * 9/1965 Gordon ..... A47B 57/48 403/387
3,217,894 A 11/1965 Shewell
3,266,635 A 8/1966 McConnell
3,278,043 A * 10/1966 Kimpton ..... A47B 57/402 211/191
3,637,087 A * 1/1972 Denny ..... A47B 57/402 211/192
3,672,515 A 6/1972 Rous
3,702,137 A 11/1972 Evans
3,741,405 A 6/1973 McConnell et al.
3,840,124 A 10/1974 Atwater
3,862,691 A * 1/1975 Mori ..... A47B 57/40 108/156
3,999,875 A 12/1976 Simon
4,129,279 A * 12/1978 Burkholder ..... A01K 31/17 248/165
4,233,912 A 11/1980 Ferdinand
4,262,809 A 4/1981 McConnell
4,342,397 A * 8/1982 Halstrick ..... A47B 57/402 403/231
4,423,817 A * 1/1984 Monjo-Rufi ..... A47B 57/30 211/187
4,450,936 A 5/1984 Strom
4,778,067 A * 10/1988 Bellerose ..... A47B 57/50 211/187
4,796,541 A * 1/1989 Halstrick ..... A47B 57/402 108/107
5,036,778 A * 8/1991 Briosi ..... A47B 57/406 211/187
5,082,388 A * 1/1992 Lauterbach ..... A47B 57/408 403/231
5,131,781 A 7/1992 Klein
D357,607 S 4/1995 Nilsson
5,407,170 A 4/1995 Slivon et al.
5,417,396 A * 5/1995 Merl ..... A47B 57/40 108/108
5,463,966 A * 11/1995 Nilsson ..... F16B 12/34 108/193
5,485,932 A * 1/1996 Romm ..... H02G 3/28 248/214
5,553,549 A * 9/1996 Nilsson ..... A47B 9/00 108/147.11
5,624,045 A 4/1997 Highsmith et al.
6,085,918 A * 7/2000 Duff ..... A47B 57/48 108/109
6,158,599 A 12/2000 Lazarus
D438,448 S 3/2001 Batting et al.
6,241,109 B1 * 6/2001 Kautz ..... A47B 57/50 403/329
6,273,281 B1 * 8/2001 Berglund ..... A47B 57/50 108/147.11
6,378,711 B1 4/2002 Skulnik et al.
6,595,379 B1 7/2003 Powell
6,920,831 B2 * 7/2005 Lin ..... A47B 57/408 211/187
7,128,225 B2 * 10/2006 Saltzburg ..... A47B 96/1441 211/187
D570,208 S 6/2008 Senn
D597,353 S 8/2009 Liss et al.
D600,362 S 9/2009 Geffe
7,591,385 B2 9/2009 Brooks
7,762,411 B2 * 7/2010 Hilburn ..... A47B 88/43 211/192
D668,945 S 10/2012 Fernandez
8,302,788 B2 11/2012 Vargo et al.
8,469,208 B2 * 6/2013 O'Day ..... A47F 7/163 403/252
8,695,816 B2 * 4/2014 Troyner ..... A47B 96/1441 211/187
8,733,564 B2 * 5/2014 Fitzgerald ..... A47B 57/50 211/191
9,027,767 B2 * 5/2015 Buckley ..... A47B 57/34 211/134
D733,473 S 7/2015 Troyner et al.
D737,613 S 9/2015 Troyner et al.
9,167,896 B1 * 10/2015 Wu ..... A47B 96/1441
9,215,926 B1 12/2015 Offerman
9,215,931 B1 12/2015 Offerman
9,241,566 B1 * 1/2016 Chen ..... A47B 55/00
9,290,322 B2 3/2016 Heijmink
D754,881 S 4/2016 Hatch et al.
9,386,855 B2 7/2016 Sabounjian
D767,169 S 9/2016 Hatch et al.
D769,037 S 10/2016 Anderson
9,713,379 B1 7/2017 Tsai
9,750,347 B2 9/2017 Nuckolls
D799,870 S 10/2017 Liss
10,376,047 B1 * 8/2019 Ebbesson ..... A47B 47/0083
D859,693 S 9/2019 Albert, IV
D877,603 S 3/2020 Barker
10,610,017 B2 4/2020 Beadle
D886,920 S 6/2020 Dunahay
10,702,062 B2 * 7/2020 Lee ..... A47B 57/50
10,806,257 B1 10/2020 Liu
D907,946 S 1/2021 Parab et al.
11,006,750 B2 * 5/2021 Chiu ..... A47B 96/06
D922,809 S 6/2021 Parab et al.
11,026,509 B2 6/2021 Walker
11,202,502 B1 12/2021 Berry et al.
11,583,073 B2 * 2/2023 Parab ..... A47B 47/027
2004/0108427 A1 * 6/2004 Chen ..... A47B 88/43 312/334.44
2005/0055967 A1 3/2005 Kariakin
2005/0103733 A1 5/2005 Saltzberg et al.
2005/0103734 A1 5/2005 Saltzberg et al.
2005/0111912 A1 5/2005 Brain et al.
2006/0175274 A1 8/2006 Yang
2007/0062898 A1 * 3/2007 Choi ..... A47B 57/408 211/187
2008/0103733 A1 5/2008 Thiel et al.
2010/0084354 A1 4/2010 Eustace
2012/0000871 A1 1/2012 Troyner et al.
2012/0067383 A1 3/2012 Derr
2013/0240471 A1 * 9/2013 Wiese ..... A47B 57/50 403/364
2014/0116973 A1 5/2014 Buckley et al.
2015/0090683 A1 4/2015 Sabounjian
2015/0282613 A1 10/2015 Chen
2015/0359330 A1 12/2015 Offerman
2017/0208946 A1 7/2017 Tsai
2017/0208948 A1 7/2017 Tsai
2017/0238703 A1 8/2017 Tsai
2017/0280875 A1 * 10/2017 Buckley ..... A47B 57/34
2017/0347793 A1 12/2017 Wang
2018/0171634 A1 6/2018 Mitchell et al.
2018/0279782 A1 * 10/2018 Liss ..... A47B 57/16
2018/0344031 A1 12/2018 Wang
2019/0029416 A1 1/2019 Lu et al.
2019/0125077 A1 5/2019 Liss et al.
2019/0328134 A1 * 10/2019 Walker ..... A47B 96/1408
2020/0054126 A1 2/2020 Globerman
2020/0359789 A1 11/2020 O'Halloran
2022/0031066 A1 2/2022 Parab et al.

(56) References Cited

U.S. PATENT DOCUMENTS

| | | | | |
|---|---|---|---|---|
| 2023/0044061 | A1* | 2/2023 | Yoon | A47B 47/0083 |
| 2023/0129296 | A1* | 4/2023 | Chakraborthy | A47B 47/0083 211/134 |
| 2023/0363530 | A1* | 11/2023 | Yoon | A47B 96/1408 |

FOREIGN PATENT DOCUMENTS

| | | | | |
|---|---|---|---|---|
| CN | 105640094 | A | 6/2016 | |
| CN | 214432773 | U | 10/2021 | |
| DE | 3936485 | A1 | 5/1991 | |
| DE | 19701280 | A1 | 7/1998 | |
| DE | 20309814 | U1 | 8/2003 | |
| DE | 20309814 | U1 * | 8/2003 | A47B 57/40 |
| DE | 202005011886 | U1 | 12/2005 | |
| DE | 102006001516 | A1 | 7/2007 | |
| EP | 0425861 | A1 | 5/1991 | |
| EP | 0890330 | A1 | 1/1999 | |
| EP | 1854375 | A1 | 11/2007 | |
| FR | 2406406 | A1 | 5/1979 | |
| FR | 2447164 | A1 | 8/1980 | |
| FR | 2889654 | A1 | 2/2007 | |
| FR | 2889654 | A1 * | 2/2007 | A47B 47/028 |
| GB | 952576 | | 3/1964 | |
| GB | 2245821 | A | 1/1992 | |
| GB | 2354934 | A | 4/2001 | |
| JP | 5147153 | B2 | 2/2013 | |
| KR | 102319236 | B1 | 11/2021 | |
| WO | WO-2023076324 | A1 * | 5/2023 | A47B 57/50 |

OTHER PUBLICATIONS

Storage Rack Beam, www.globalindustrial.com <http://www.globalindustrial.com> [online]. Published on or before Aug. 1, 2020, [retrieved on Aug. 1, 2020]. Retrieved from the Internet: <URL :<https://www.globalindustrial.conn/p/storage/bulk-rack/extra-heavy-duty/interlake-bulk-storage-rack-beam-zs-48-inch-I-for-metal-shelves» (Year: 2020).

European Patent Office, International Search Report and Written Opinion in PCT Application No. PCT/US2020/029247, dated Jun. 9, 2020.

The International Bureau of WIPO, International Preliminary Report on Patentability in PCT Application No. PCT/US2020/029236, dated Nov. 4, 2021.

The International Bureau of WIPO, International Preliminary Report on Patentability in PCT Application No. PCT/US2020/029247, dated Nov. 4, 2021.

U.S. Patent and Trademark Office, Office Action issued in related U.S. Appl. No. 17/264,387 dated Mar. 22, 2022, 32 pages.

U.S. Patent and Trademark Office, Office Action issued in related U.S. Appl. No. 17/264,376 dated Apr. 1, 2022, 21 pages.

International Searching Authority, International Search Report and Written Opinion, issued in corresponding PCT Application No. PCT/US2022/047798, dated Jan. 24, 2023.

* cited by examiner

WELDLESS SHELF SUPPORT BEAMS AND SHELVING UNITS UTILIZING SAME

CROSS-REFERENCE TO RELATED APPLICATIONS

This application claims the benefit of U.S. Provisional Application Ser. No. 63/315,744 filed on Mar. 2, 2022 and U.S. Provisional Application Ser. No. 63/272,385 filed on Oct. 27, 2021, the disclosures of which are incorporated by reference in their entirety.

TECHNICAL FIELD

This invention relates to shelving units, and more particularly to shelf support beams for use with shelving units.

BACKGROUND

Shelving units are commonly used for storing various items in a space-efficient manner. Such units typically include four vertical support posts arranged at corners of a generally rectangular pattern. Horizontal front and rear shelf support beams extend between the two front corner support posts and between the two rear corner support posts. Shorter horizontal shelf support beams are often positioned on opposing sides of the unit and extend between a front corner support post and a rear corner support post. In a conventional arrangement, such shelving units define multiple shelves and supporting beams one above the other with the corner support posts and shelf support beams of metal. For example, these components are often formed of sheet metal or steel and, in combination with shelves, are generally referred to as steel shelving or storage units.

As demand for metal shelving units rises, it becomes increasingly desirable to improve the design of shelving unit components to thereby reduce the cost to manufacture the components. This process may be referred to in industry as Design for Manufacturing (DFM), which is the process of designing components for ease of manufacturing those components at a lower cost.

Reducing the number of parts in a product is one way to improve manufacturability and reduce cost. For example, certain components of a shelving unit, such as the shelf support beams, comprise several parts that are each individually manufactured, or machined, in a first manufacturing step and coupled together, such as by welding, in a second manufacturing step. Each step may be performed at a different manufacturing facility which requires the parts to be shipped for assembly, resulting in an additional manufacturing step and cost. For example, one way to improve a component's design for ease of manufacturing is to design the component in a way that eliminates one or more processing steps required to manufacture the component. Thus, an end goal of the DFM process is to achieve a component design that is both minimally complex from a manufacturing standpoint, yet the component retains a desired performance rating or has improved performance.

To this end, while metal shelving units are generally successful for their intended purpose and remain useful and popular with consumers, manufacturers and other providers continually strive to improve upon their design for purposes of manufacturability. In this regard, it is desirable to reduce the cost, including materials, processing steps, and time required to manufacture certain components of shelving units without any significant loss in performance of those components. Furthermore, it is desirable to both improve the performance and ease of manufacturing of those components.

SUMMARY

In a first aspect of the invention, a shelf support beam for use in a shelving unit to support a shelf is disclosed. The shelf support beam includes a first end and a second end located at opposite longitudinal ends of the shelf support beam between which a structural member extends. The structural member is C-shaped in cross-section and includes a web that separates a top flange from a bottom flange. The bottom flange of the structural member is configured to support the shelf. The shelf support beam further includes a tab located at each of the first and second ends of the structural member. Each tab includes a pair of securing fingers. The shelf support beam also includes an enforcement tab formed in the web at each of the first and second ends of the structural member. To this end, each securing finger is angled inwardly toward the enforcement tab relative to a plane disposed perpendicular to a longitudinal axis of the shelf support beam to define a securing finger angle for each securing finger. The securing finger angle for each securing finger may be within a range of between 10° to 20°. The shelf support beam is designed for ease of manufacturing and is capable of being formed from a single piece of material. Furthermore, the arrangement of each securing finger and enforcement tab, which may be punch-formed in the shelf support beam, cooperate to provide the shelf support beam with an improved load carrying capacity compared to conventional, multi-piece horizontal support beams used for shelving units.

In one embodiment, each securing finger may include a stiffening rib. For example, in one embodiment, each stiffening rib may arcuately extend from a first terminal end on the tab to a second terminal end on the securing finger. The stiffening rib reinforces the respective securing finger against out of plane deformation when the support beam is under load. To this end, each securing finger and stiffening rib may be punch-formed.

In one embodiment, the top flange and the bottom flange of the structural member may be truncated at each of the first and second end of the shelf support beam to define abutment edges. In that regard, each tab may extend a distance beyond the abutment edges the first and second ends of the shelf support beam so as to be an extension of the web. In a further embodiment, each enforcement tab may include an outer surface that is generally coplanar with the abutment edges at each of the first and second end of the shelf support beam.

In yet another embodiment, each enforcement tab may terminate at base edge and a top edge. For example, the base edge may be located opposite a first one of the pair of securing fingers and the top edge may be located opposite a second one of the pair of securing fingers. In a further embodiment, each enforcement tab may define an elongate length between the base edge and the top edge. In that regard, the elongate length of each enforcement tab may be less than a distance that the pair of securing fingers are spaced apart.

In a second aspect of the invention, a shelving unit is disclosed. The shelving unit includes a plurality of posts, a plurality of shelves, and a plurality of shelf support beams. Each of the plurality of shelf support beams is configured to be attached to two posts of the plurality of posts to thereby support one of the plurality of shelves. Each shelf support beam includes a first end and a second end located at opposite longitudinal ends of the shelf support beam between which a structural member extends. The structural member is C-shaped in cross-section and includes a web that separates a top flange from a bottom flange. The bottom flange of the structural member is configured to support the shelf. Each shelf support beam further includes a tab located at each of the first and second ends of the structural member. Each tab includes a pair of securing fingers. Each shelf support beam also includes an enforcement tab formed in the web at each of the first and second ends of the structural member. To this end, each securing finger is angled inwardly toward the enforcement tab relative to a plane disposed perpendicular to a longitudinal axis of the shelf support beam to define a securing finger angle for each securing finger. The securing finger angle for each securing finger may be within a range of between 10° to 20°.

In one embodiment, each securing finger may include a stiffening rib. For example, in one embodiment, each stiffening rib may arcuately extend from a first terminal end on the tab to a second terminal end on the securing finger. The stiffening rib reinforces the respective securing finger against out of plane deformation when the support beam is under load. To this end, each securing finger and stiffening rib may be punch-formed.

In one embodiment, the top flange may include an elevated portion and a shelf support portion separated by a sidewall. For example, the sidewall may have an S-shaped configuration with the shelf support portion being configured to support the shelf and the sidewall being configured to prevent lateral motion of the shelf toward the web.

In another embodiment, the top flange and the bottom flange of the structural member may be truncated at each of the first and second end of the shelf support beam to define abutment edges. For example, in one embodiment, each enforcement tab may include an outer surface that is coplanar with the abutment edges at each of the first and second ends of the shelf support beam.

In one embodiment, each of the plurality of posts of the shelving unit may include pairs of keyholes distributed along a length of the corner post. Each keyhole may be configured to receive a respective one of the pair of securing fingers therein to secure the shelf support beam to a respective post. In that regard, each keyhole may include a V-shaped portion that transitions to a rectangular-shaped portion. The V-shaped portion may have a vertical edge and a step-shaped angled edge that each extend from the V-shaped portion to the rectangular-shaped portion. To this end, the angled edge may have an angular relationship relative to the vertical edge that defines a keyhole angle. For example, in one embodiment, the keyhole angle for each keyhole is within a range of between 10° to 20°.

Additional features and advantages will be set forth in the detailed description which follows, and in part will be readily apparent to those skilled in the technical field of optical connectivity. It is to be understood that the foregoing general description, the following detailed description, and the accompanying drawings are merely exemplary and intended to provide an overview or framework to understand the nature and character of the claims.

BRIEF DESCRIPTION OF THE DRAWINGS

The accompanying drawings are included to provide a further understanding and are incorporated in and constitute a part of this specification. The drawings illustrate one or more embodiment(s), and together with the description serve to explain principles and operation of the various embodiments. Features and attributes associated with any of the embodiments shown or described may be applied to other embodiments shown, described, or appreciated based on this disclosure.

DETAILED DESCRIPTION

Figure 1:
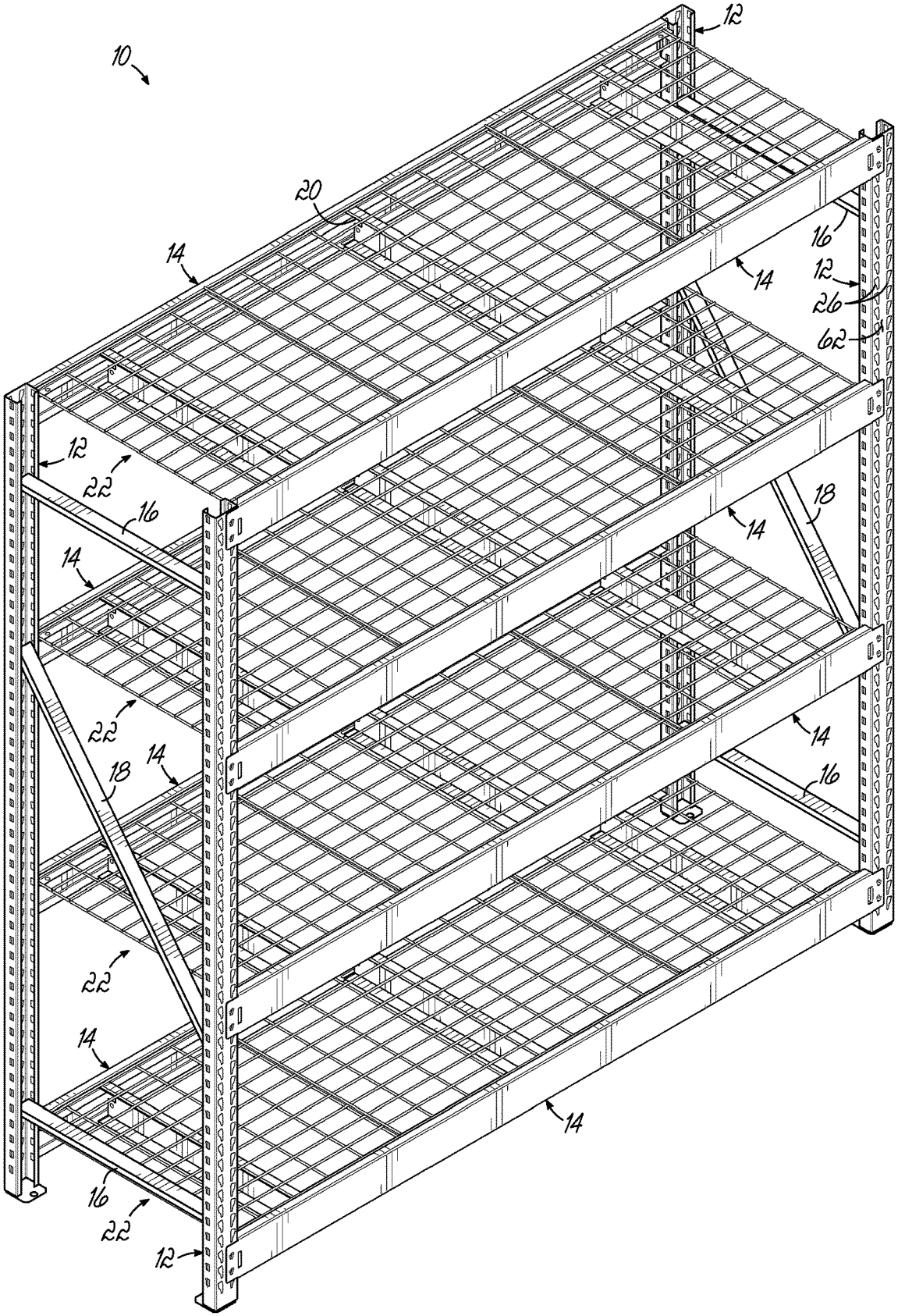
FIG. 1 is an isometric view of an exemplary shelving unit in accordance with an embodiment of the invention.
Figure 2:
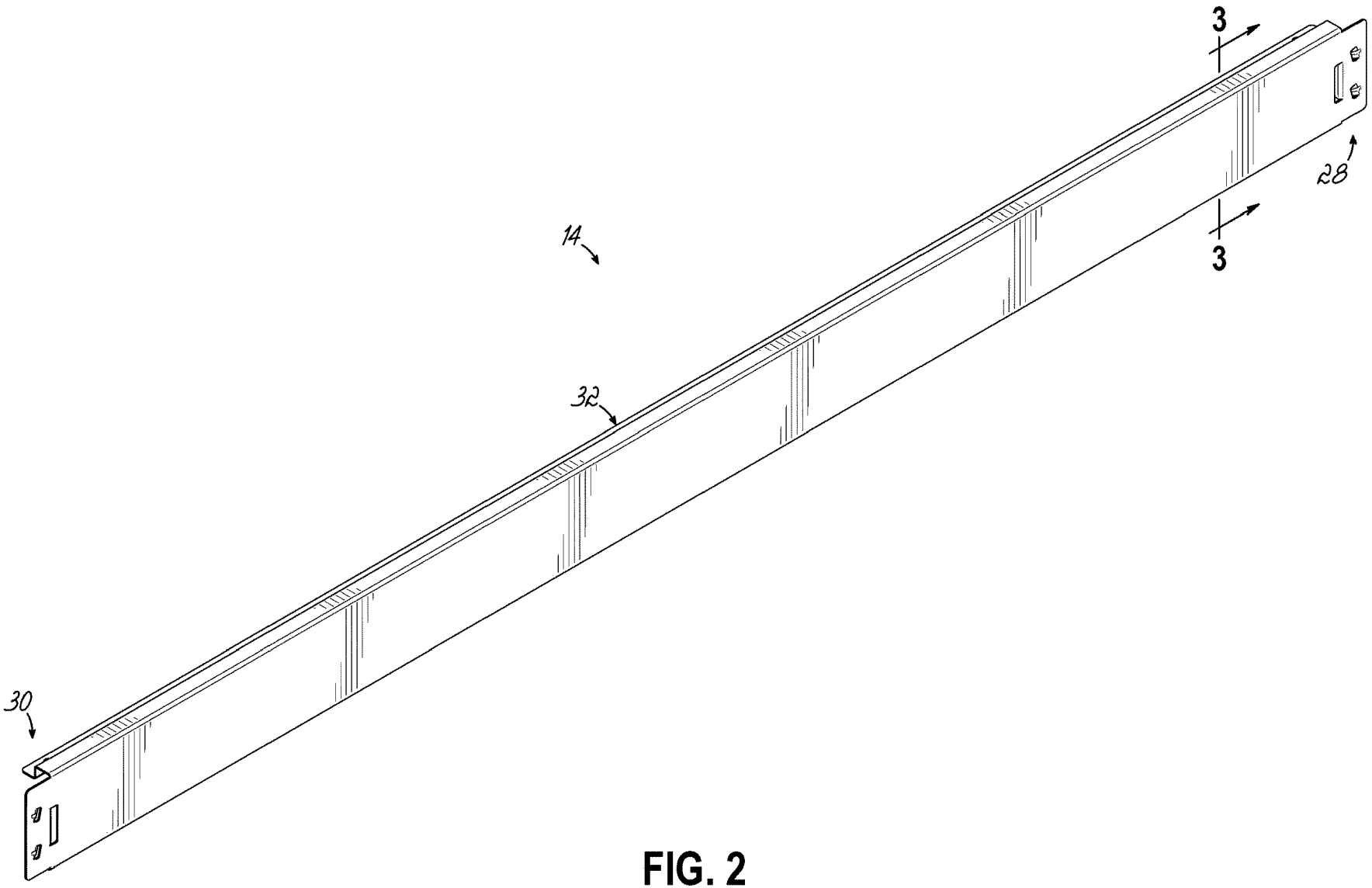
FIG. 2 is a perspective view of a front side of a shelf support beam according to one embodiment of the invention.
Figure 3:
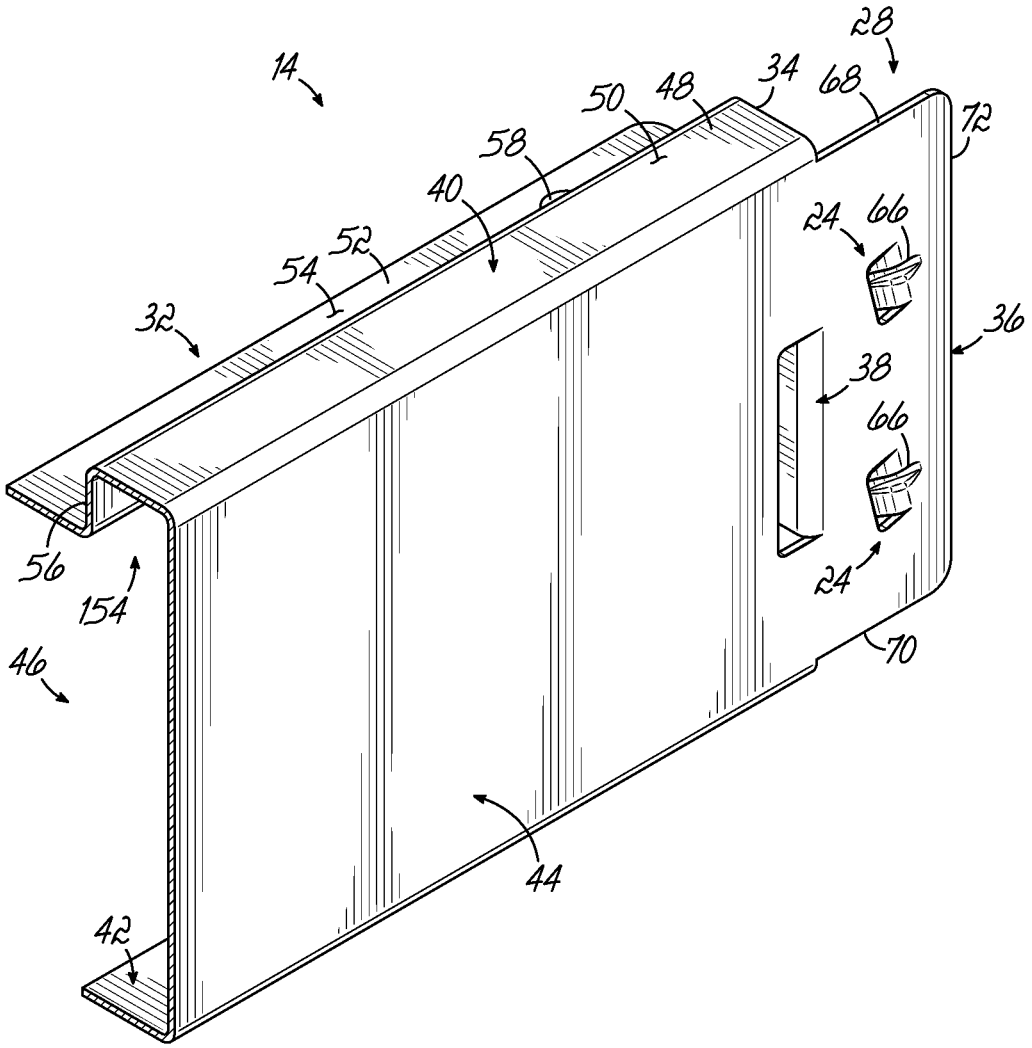
FIG. 3 is a cross-sectional view of the shelf support beam of FIG. 2 taken along line 3-3, illustrating a first end of the shelf support beam.
Figure 4:
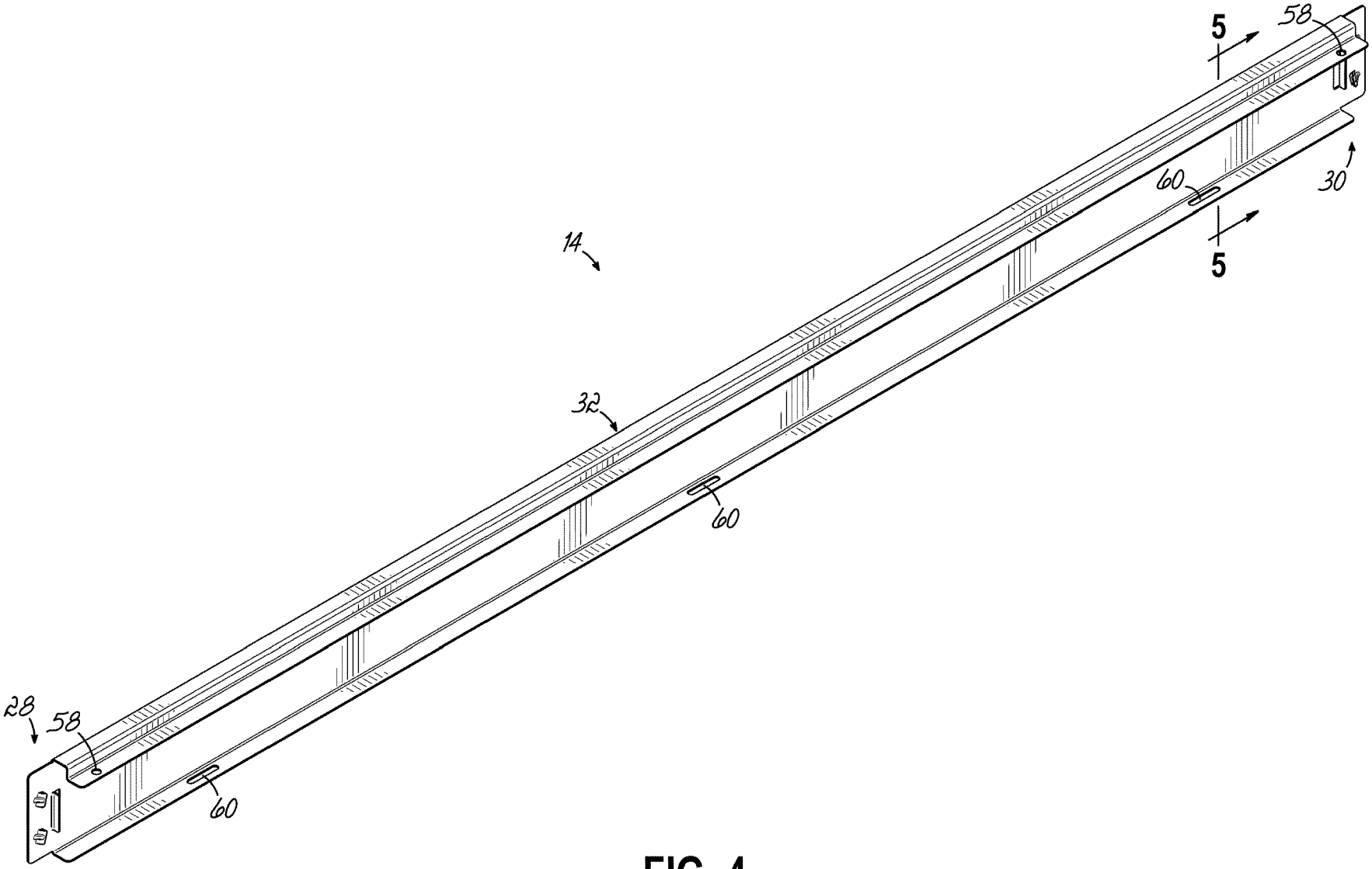
FIG. 4 is a perspective view of a back side of the shelf support beam of FIGS. 2-3.
Figure 5:
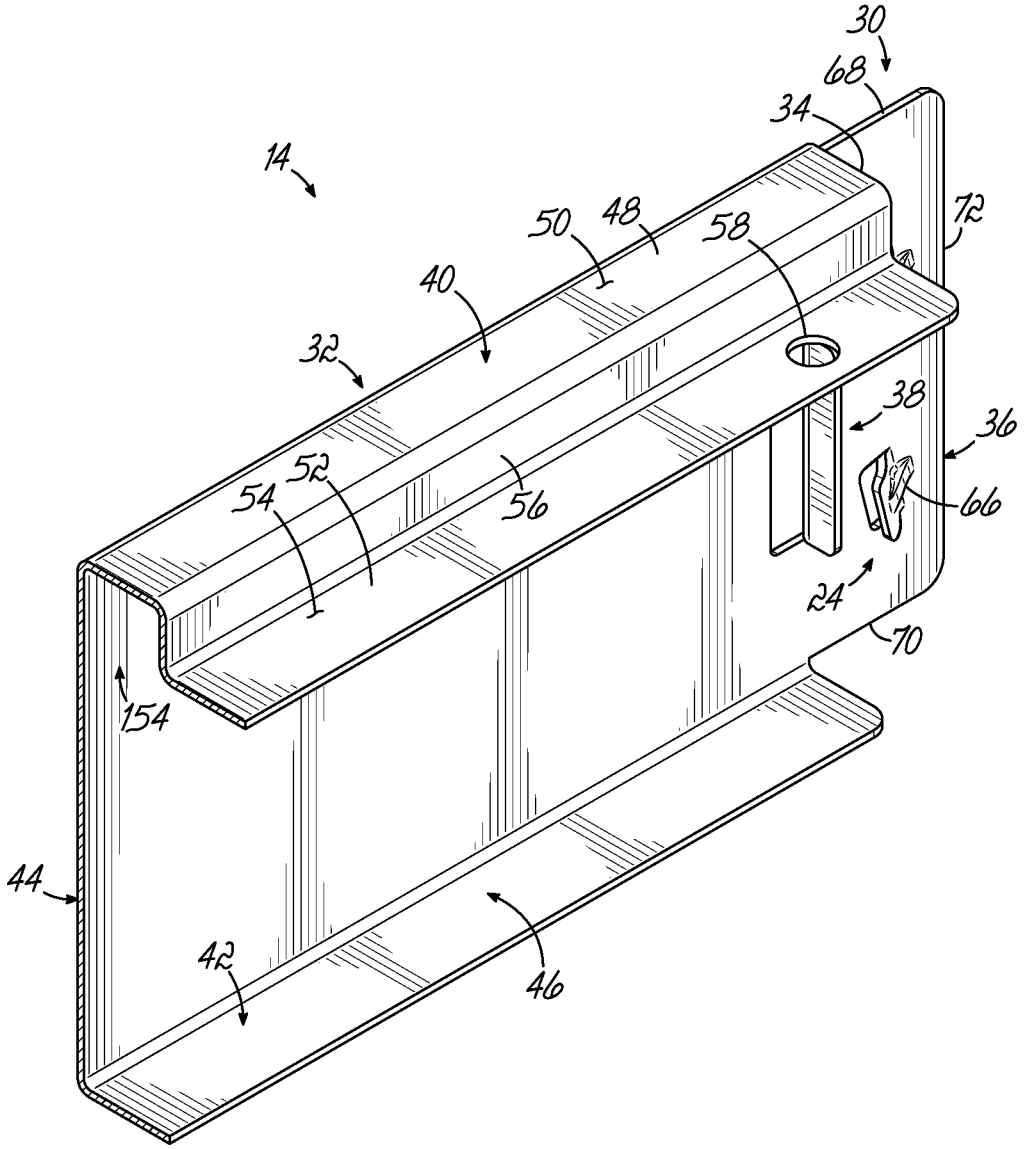
FIG. 5 is a cross-sectional view of the shelf support beam taken along line 5-5 of FIG. 4, illustrating a second end of the shelf support beam.

With reference to FIG. 1, details of a shelving unit 10 are shown in which shelf support beams according to embodiments of the present invention have particular utility and/or aesthetic value. As shown, the shelving unit 10 includes four corner posts 12 arranged in a generally rectangular configuration. A front pair of corner posts 12 cooperate to carry one or more front horizontal shelf support beam(s) 14, and a rear pair of corner posts 12 cooperate to carry one or more rear horizontal shelf support beam(s) 14. As described in further detail below, the support beams 14 are formed by bending a single sheet of material, such as sheet of metal. Furthermore, appropriate fastening means used to selectively couple the shelf support beams 14 to corresponding corner posts 12 are punch-formed in the single sheet of material. In this regard, conventional shelf support beam designs require at least one secondary manufacturing operation, such as welding, to attach a fastening means to the formed beam 14, which results in at least one additional manufacturing step, if not several. Applicant discovered that by punch-forming the fastening means and roll-forming the beam 14, the beam 14 may be formed from a single piece of material thereby eliminating the need for additional manufacturing or processing steps. Thus, according to embodiments of the present invention, horizontal shelf support beams 14 are designed for ease of manufacturing and are capable of being formed from a single piece of material, requiring only minimal manufacturing processing steps, yet the shelf support beams 14 maintain or have improved load carrying capacity compared to conventional, multi-piece horizontal support beams used for shelving units.

With continued reference to FIG. 1, one or more side rails 16 and/or diagonal braces 18 couple each front corner post 12 with a corresponding rear corner post 12. Although not shown, corner posts 12 can carry side horizontal shelf support beams in addition or as an alternative to the side rails 16 and/or diagonal braces 18. In this configuration, horizontal shelf support beams 14 would form an outer rim at one level of the shelving unit 10 and so extend between each post 12. In either case, extending between each pair of horizontal shelf support beams 14 are one or more crossbeams 20. Collectively, the pair of horizontal shelf support beams 14 and one or more crossbeams 20 support a shelf 22 of the shelving unit 10. Items (not shown) may be stored on the shelf 22 in the normal course of using the shelving unit 10. These items produce a load due to gravity on each of the shelf support beams 14 and crossbeams 20, which is transferred to the posts 12. One or more of the shelves 22 of the shelving unit 10, and preferably each of the shelves 22 of the shelving unit 10, may be configured as a wire rack. Other shelf 22 configurations, such as solid shelves, are also possible.

The horizontal shelf support beams 14 are configured to be selectively coupled to the posts 12 via releasable fastening means located at opposite ends of the shelf support beam 14. More particularly and as will be described in further detail below, each end of the horizontal shelf support beams 14 includes a pair of punch-formed securing fingers 24 that are configured to be received within corresponding H-shaped or V-shaped keyholes 26 that are distributed along the length of the corner posts 12. The horizontal shelf support beams 14 couple to the corner posts 12 at the keyholes 26 and may be moved vertically with respect to the posts 12 such that the number of horizontal shelf support beams 14 and their respective heights along the posts 12 may be varied. Each end of the horizontal shelf support beams 14 further includes an enforcement tab 38 that serves to increase the surface contact between the shelf support beam 14 and the corner posts 12 to which the beam 14 is coupled to reduce torsion of the beam 14 when under load, as will be described in further detail below. As shown in FIG. 1, the shelving unit 10 includes four horizontal shelves 22 supported by shelf support beams 14 and corresponding crossbeams 20 according to embodiments of the invention. However, it will be appreciated that any number of shelves 22 and corresponding horizontal shelf support beams 14 and crossbeams 20 may be used.

As described above, according to aspects of the present invention, the horizontal shelf support beams 14 are each formed from a single piece or sheet of material, otherwise referred to as a blank. The material may be sheet metal such as alloy steel, stainless steel, carbon steel, aluminum, or other suitable metal, for example. The horizontal shelf support beams 14 may be formed without the need for secondary manufacturing processes such as welding one or more components together to form the finished horizontal shelf support beam. Thus, the horizontal shelf support beam 14 is not a multi-piece or multi-component beam. Rather, the horizontal shelf support beam 14 is a unitary or monolithic beam. As will be described in further detail below, the horizontal shelf support beams 14 may be formed with minimal processing steps.

With reference to FIGS. 2-11, details of the horizontal shelf support beam 14 according to one embodiment of the invention are shown and will now be described. In this regard, the shelf support beam 14 includes a first end 28 and a second end 30 located at opposite longitudinal ends of the shelf support beam 14 between which a structural member 32 that is formed in a generally C-shape extends. The generally C-shaped structural member 32 is partially truncated near each of the first and second ends 28, 30 to define abutment edges 34 of the structural member 32 as well as plate-like tabs 36 at each end 28, 30 of the shelf support beam 14. The plate-like tabs 36 each extend a distance, in a longitudinal direction along an axial length of the support beam 14, from each corresponding abutment edge 34 of the structural member 32. Each tab 36 includes a pair of punch-formed securing fingers 24 for securing ends 28, 30 of the shelf support beam 14 to corresponding corner posts 12 of the shelving unit 10, and an enforcement tab 38.

Figure 11:
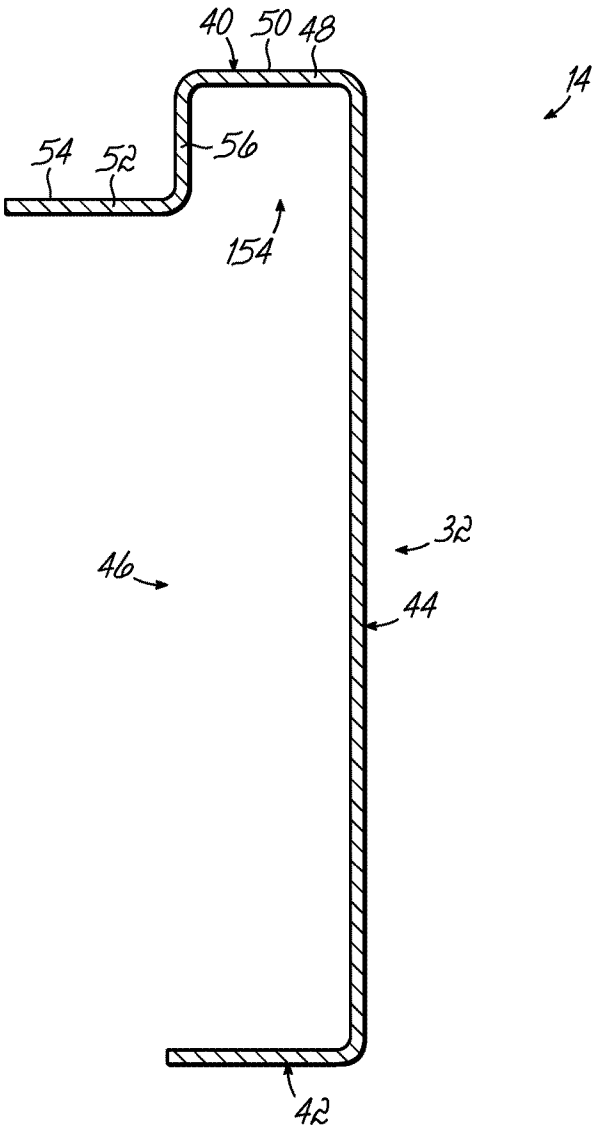
FIG. 11 is a cross-sectional view of the shelf support beam of FIGS. 2-10 taken at a midpoint along the shelf support beam.
Figure 10:
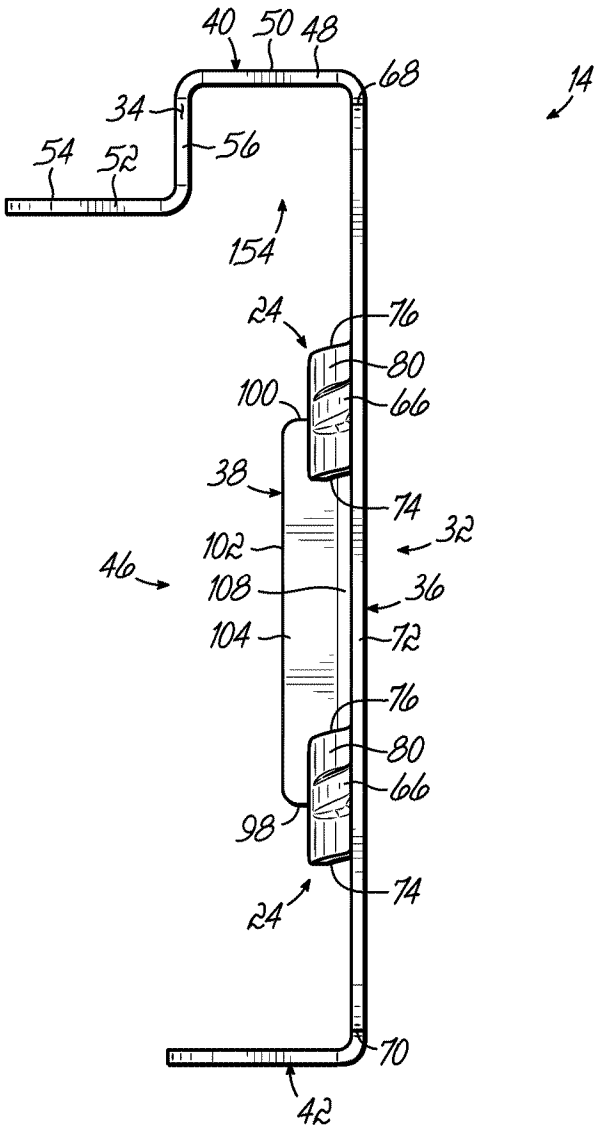
FIG. 10 is an end view of the shelf support beam of FIGS. 2-9.

As best shown in FIGS. 10-11, the structural member 32 has a C-shaped cross-sectional configuration and includes a top flange 40 and a bottom flange 42 between which a web 44 extends. The web 44 forms a vertical portion of the structural member 32 during use. Collectively, the web 44, top flange 40, and bottom flange 42 form the C-shape of the structural member 32 and further define a channel 46 that extends a length of the structural member 32. The web 44 may be radiused at each of the locations at which the structural member 32 transitions to the top flange 40 and to the bottom flange 42. In any event, the top flange 40 is configured to receive a shelf 22 and extends generally inwardly in the shelving unit 10 (e.g., FIG. 1) and in a direction away from the web 44. More particularly, the top flange 40 has an S-shaped configuration with an elevated portion 48 defining a top surface 50 and a lower portion 52 defining a lower surface 54. A sidewall 56 transitions from the elevated portion 48 to the lower portion 52 to provide the S-shaped configuration.

A shelf 22 is supported on lower portion 52 with the sidewall 56 providing a stop for lateral movement of the shelf 22 in an outward direction (i.e., toward the web 44) in the shelving unit 10. The lower portion 52 may have one or more bores 58 located therein with at least one bore 58 being located near each end 28, 30 of the shelf support beam 14 (e.g., FIGS. 4-5). The bores 58 are configured to receive a tie member, such as a wire tie clip, used to increase the load capacity of the shelving units. This positive connection prevents the shelves 22 from unintentional and undesirable movement during use and during movement or transport of the shelving unit 10. By way of example only, tie clips are shown and described in commonly owned U.S. Pat. No. 10,806,251, which is incorporated by reference herein in its entirety. In any event, a pair of existing shelf support beams 14 positioned on the front and rear sides of the shelf 22 captures the shelf 22 between opposing sidewalls 56 to prevent unwanted lateral movement of the shelf 22. Generally, a height of the sidewall 56 (e.g., a distance between the lower surface 54 and the top surface 50) may be approximately a thickness of a shelf 22. The shelf 22 is then approximately flush with the top surface 50. The top surface 50 may be a flat surface and generally planar or parallel with the lower surface 54 and the bottom flange 42.

The bottom flange 42 joins the web 44 on an opposite end of the web 44 from the top flange 40. The bottom flange 42 is configured to receive the one or more crossbeams 20 and extends generally inwardly in the shelving unit 10 (e.g., FIG. 1) and in a direction away from the web 44. The bottom flange 42 includes one or more spaced apart apertures 60 (e.g., FIG. 4) configured to receive and secure an end of a corresponding crossbeam 20 to the bottom flange 42. The apertures 60 are oblong in shape and are spaced apart a desired distance along a length of the bottom flange 42. For example, each horizontal shelf support beam 14 may have three apertures 60 spaced equally apart along a length of the beam 14 to support three corresponding crossbeams 20.

Referring now to FIGS. 2-9, the plate-like tabs 36 are an extension of the web 44 at each end 28, 30 of the shelf support beam 14. In this regard, the top flange 40 and the bottom flange 42 define the abutment edges 34 at each end 28, 30 of the shelf support beam 14. When coupled between a pair of corner posts 12, each tab 36 is configured to engage with an outwardly facing surface 62 of the corner post 12 while the abutment edges 34 are configured to engage with an inwardly facing surface 64 of the corner post 12 (e.g., FIG. 12). The H-shaped or V-shaped keyholes 26 are formed in the outwardly facing surface 62 of each corner post 12. The engagement between the tabs 36 and abutment edges 34 and corresponding corner posts 12 is maintained as a result of the engagement between each securing finger 24 and corresponding keyhole 26, as well as the enforcement tab 38 and the corner post 12, as will be described in further detail below.

With continued reference to FIGS. 2-9, details of the securing finger 24 are shown and will now be described with respect to the first and second ends 28, 30 of the shelf support beam 14. While the securing fingers 24 and enforcement tab 38 are shown and described with respect to certain ends 28, 30 of the shelf support beam 14, it is understood that the securing fingers 24 and enforcement tab 38 at each end 28, 30 of the shelf support beam 14 are similarly configured. In that regard, each end 28, 30 of the shelf support beam 14 includes two securing fingers 24 that extend generally inwardly in the shelving unit 10 (e.g., FIG. 1) and in a direction toward the channel 44 and the center of the beam 14. Each securing finger 24 is punch-formed in the respective tab 36 of the support beam 14 so as to be partially cut from the tab 36 and bent inwardly (i.e., in a direction toward to the channel 46 formed by the beam 14) to form the shape of the securing finger 24. In that regard, each securing finger 24 may have a same thickness as the tab 36. As shown, each securing finger 24 further includes a stiffener or stiffening rib 66 that is formed in each finger 24 and the tab 36 during punch-forming of the securing finger 24, as will be described in further detail below.

As shown in FIGS. 6-9, the securing fingers 24 are aligned on the tab 36 and spaced apart a distance along a height of the tab 36. The height of the tab 36 is a distance between an upper edge 68 and a lower edge 70 of the tab 36. In that regard, one securing finger 24 is located closer to the upper edge 68 of the tab 36 with the other securing finger 24 being located closer to the lower edge 70 of the tab 36. Further, the securing fingers 24 are positioned between an end edge 72 of the tab 36 and the abutment edges 34 so as to be generally centered therebetween on the tab 36. However, the securing fingers 24 may be slightly offset in either direction so as to be closer to the end edge 72 of the tab 36 or the abutment edges 34, for example.

Figure 9:
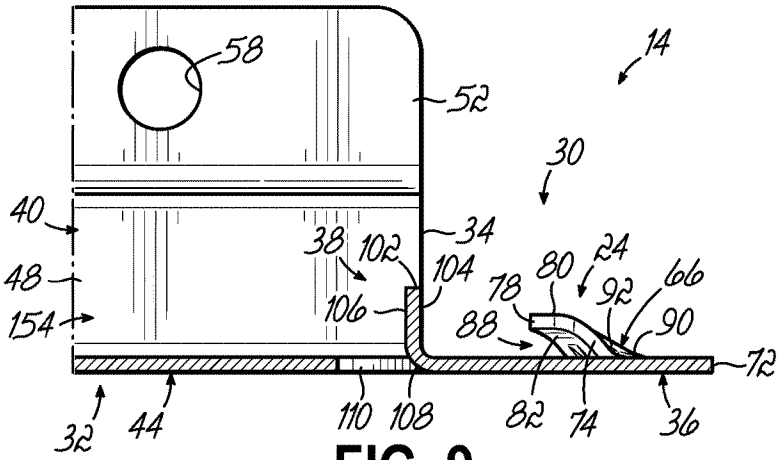
FIG. 9 is a cross-sectional view of the first end of the shelf support beam taken along line 9-9 of FIG. 8.

With continued reference to FIGS. 6-9, each securing finger 24 has a generally rectangle-shaped profile and includes a base edge 74, a top edge 76, a distal edge 78, an outer surface 80, and an inner surface 82. As best shown in FIG. 9, the inner and outer surfaces 82, 80 of each securing finger 24 are curved to provide each securing finger 24 with a generally S-shaped configuration. Each securing finger 24 projects from a bend line 84 on the tab 36, in a direction toward the enforcement tab 38, to the distal edge 78 which is spaced a distance away from the tab 36. Forming of the securing finger 24 results in a rectangle-shaped aperture 86 being formed in the tab 36 beneath the inner surface 82 of the finger 24 (e.g., FIGS. 5-6). To this end, the space between the inner surface 82 of each finger 24 and the respective aperture 86 of the tab 36 defines a pocket 88. The pocket 88 is configured to face, or open towards the enforcement tab 38, and may be V-shaped, for example. In that regard, when the shelf support beam 14 is engaged with the corner post 12, each securing finger 24 is engaged with a corresponding keyhole 26 such that a portion of the corner post 12 is received within each pocket 88.

Figure 7:
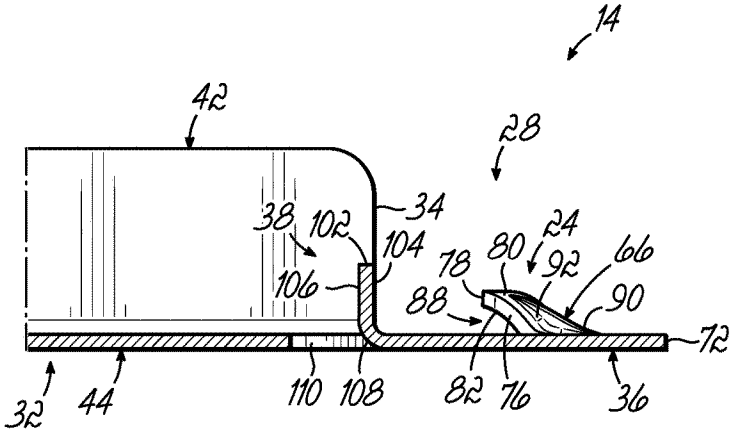
FIG. 7 is a cross-sectional view of the shelf support beam taken along line 7-7 of FIG. 6, illustrating the first end of the shelf support beam.
Figure 6:
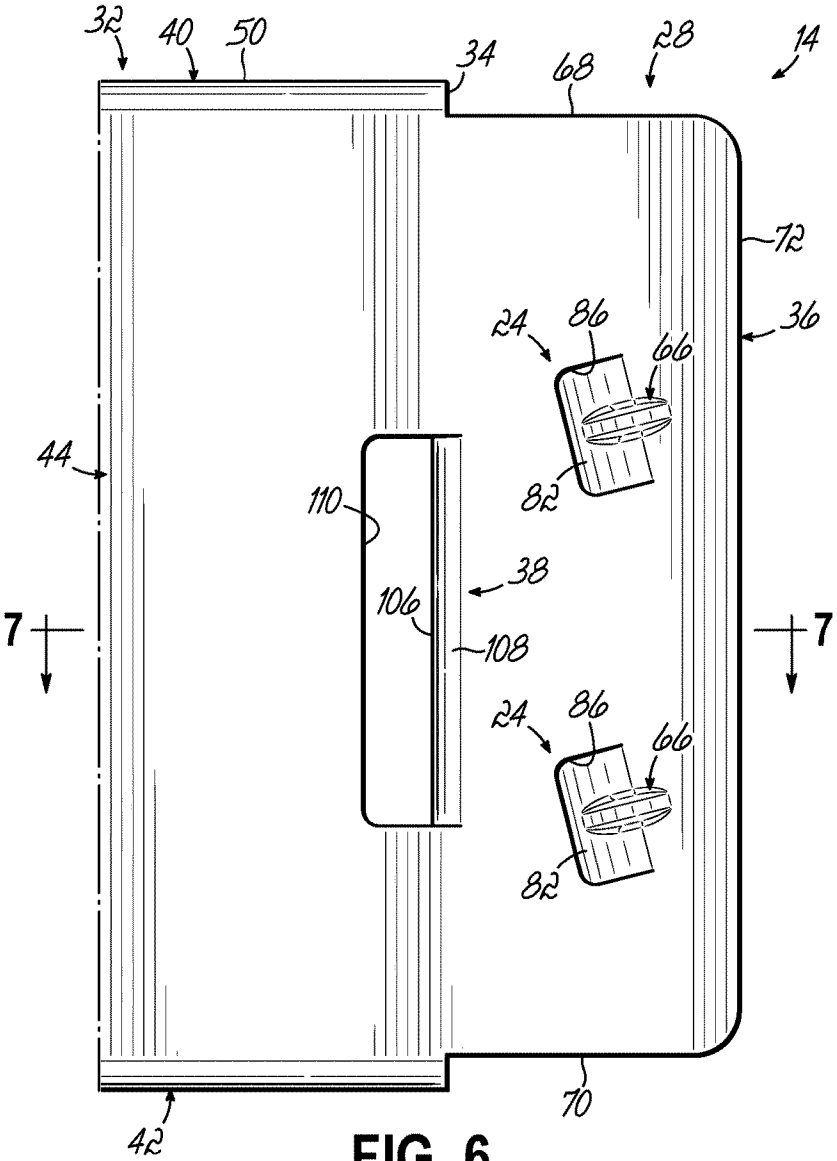
FIG. 6 is plan view of the front side of the first end of the shelf support beam of FIGS. 2-5.
Figure 8:
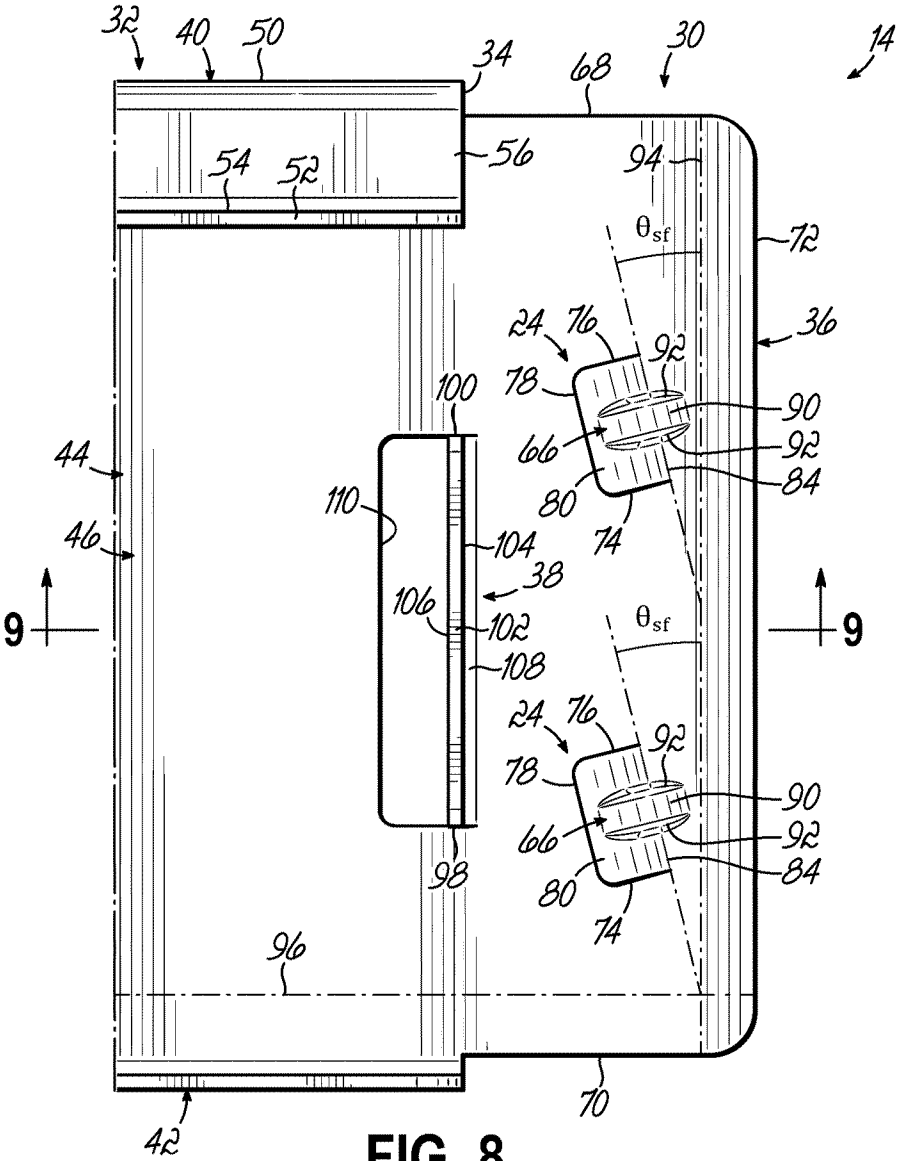
FIG. 8 is plan view of the back side of the second end of the shelf support beam of FIGS. 2-7.

As briefly described above, each securing finger 24 also has a stiffening rib or stiffener 66 that is formed during the punch-forming of each securing finger 24. In that regard, the same punch may be used to form both the securing finger 24 and the stiffener 66 at the same time, for example. The stiffener 66 is configured to strengthen or stiffen the securing finger 24 against out of plane deformation when the support beam 14 is under load, particularly along the bend line 84 of the securing finger 24. As shown in FIGS. 6-8, each stiffener 66 is formed so as to arcuately extend from the tab 36 a distance along the outer surface 82 of the respective securing finger 24. Each stiffening rib 66 includes a raised spine 90 that defines a generally flat surface and a pair of radiused sidewalls 92 that extend between the spine 90 and surfaces of the securing finger 24 and the tab 36. As shown, each spine 90 arcuately extends from a first terminal end on the tab 36 to a second terminal end on the securing finger 24. More particularly, each stiffener 66 extends across the bend line 84 in a generally perpendicular manner such that a height of each stiffener 66 is generally greatest in a region where the stiffener 66 passes over the bend line 84.

Referring now to FIG. 8, the bend line 84 of each securing finger 24 is angled relative to a plane axis 94 disposed perpendicular to a longitudinal axis 96 of the shelf support beam 14 such that the entirety of each securing finger 24 is angled inwardly away from the end edge 72 of the tab 36 and toward a center of the structural member 32. Stated another way, the securing fingers 24 are each angled inwardly toward the enforcement tab 38. In this regard, the top edge 76 of each securing finger 24 is positioned closer to the enforcement tab 38 compared to the base edge 74 of each securing finger 24. The angled relationship between the bend lines 84 and the plane axis 94 defines a securing finger angle $\theta_{sf}$ for each securing finger 24. The securing finger angle $\theta_{sf}$ may be the same or different for each securing finger 24. In any event, the securing finger angle $\theta_{sf}$ for each securing finger 24 may be within a range of between 5° to 30°, for example. Preferably, the angle $\theta_{sf}$ is within a range of between 10° to 20° and, in the embodiment shown, the securing finger angle $\theta_{sf}$ is 11° for each securing finger 24. As described in further detail below, the securing finger angle $\theta_{sf}$ generally corresponds to a configuration of the keyholes 26 formed in the corner posts 12.

With reference to FIGS. 2-10, ends 28, 30 of the shelf support beam 14 also include the enforcement tab 38 which is formed in the structural member 32 between the top flange 40 and the bottom flange 42 so as to be generally in-line (or co-planar) with the abutment edges 34 (e.g., FIGS. 7-8). Each enforcement tab 38 serves to increase the surface contact between the shelf support beam 14 and the corner posts 12 to which the beam 14 is coupled. The increase in surface contact reduces torsion of the shelf support beam 14 when under load, thereby increasing the load bearing capacity of the shelf support beam 14. Moreover, the combination of the pair of securing fingers 24 and the enforcement tab 38 at each end 28, 30 of the shelf support beam 14 results in an increased load bearing capacity for the shelf support beam 14. Each enforcement tab 38 is also punch-formed in in the beam 14. To this end, each of the securing fingers 24 and enforcement tabs 38 are punch-formed and comprise a single layer, or sheet, of material which reduces the manufacturing steps needed to form the single-piece shelf support beam 14.

As shown in FIGS. 6-9, the enforcement tab 38 has a generally rectangle-shaped profile and includes a base edge 98, a top edge 100, a distal edge 102, an outer surface 104, and an inner surface 106. The inner and outer surfaces 104, 106 are generally planar such that the enforcement tab 38 has a cross-section that is generally rectangular in shape. The enforcement tab 38 projects from a bend line 108 to the distal edge 102 so as to be generally perpendicular to the tab 36 and web 42, as shown in FIG. 9. Punch-forming of the enforcement tab 38 results in a rectangle-shaped aperture 110 being formed generally in the web 42 of the structural member 32. To this end, the aperture 110 is located between the enforcement tab 38 and the center of the structural member 32. Once formed, the enforcement tab 38 has a height defined by a distance between the bend line 108 and the distal edge 102, and a length defined by a distance between the base edge 98 and the top edge 100. As shown, the length is greater than the height of the enforcement tab 38 to maximize surface contact potential between the enforcement tab 38 and the post 12 while limiting a width of the aperture 110 (e.g., a distance that the aperture 110 extends along the longitudinal axis 96 of the shelf support beam 14). An aperture 110 with a large width may weaken the beam 14 at the ends 28, 30, particularly with respect to torsional forces, and compromise the load bearing capacity of the beam 14. A longitudinal axis of the enforcement tab 38 (i.e., a line extending along the length of the enforcement tab 38) is generally perpendicular to the longitudinal axis 96 of the shelf support beam 14 and generally parallel with plane axis 94. To this end, the securing fingers 24 are also angled relative to the enforcement tab 38.

With continued reference to FIGS. 6-9, the enforcement tab 38 is spaced away from the pair of securing fingers 24 so as to be located between the top flange 40 and the bottom flange 42 of the structural member 32. More particularly, the enforcement tab 38 is generally centered between the lower portion 52 of the top flange 40 and the bottom flange 42. The enforcement tab 38 is positioned such that the top edge 100 of the enforcement tab 38 opposes one of the securing fingers 24 and the base edge 98 of the enforcement tab 38 opposes the other one of the securing fingers 24. The enforcement tab 38 does not, for example, extend to the top edge 68 and the lower edge 70 of the tab 36, but instead has a length configured to provide sufficient contact between the shelf support beam 14 and the corner post 12 to which it is attached. The length may also be determined based on manufacturing considerations. As such, in one embodiment it is preferable that the enforcement tab 38 have a length such that neither the base edge 98 nor the top edge 100 extend beyond respective securing fingers 24 but may be at a position between the respective securing finger 24 and the upper or lower edge 68, 70 of the tab 36. In one specific example, the base edge 98 and the top edge 100 terminate approximately at a location opposite the midpoint of the respective securing fingers 24. As shown in FIG. 10, the height of the enforcement tab 38 is greater than a height of the pair of securing fingers 24 measured from surfaces of the web 44 and tab 36, for example. As the enforcement tab 38 is located on the web 44 of the structural member 14, rather than the tab 36, for example, the outer surface 104 of the enforcement tab 38 is coplanar with the abutment edges 34 to engage with the inwardly facing surface 60 of the corner post 12 (e.g., FIG. 9), as will be described in further detail below.

Figure 12:
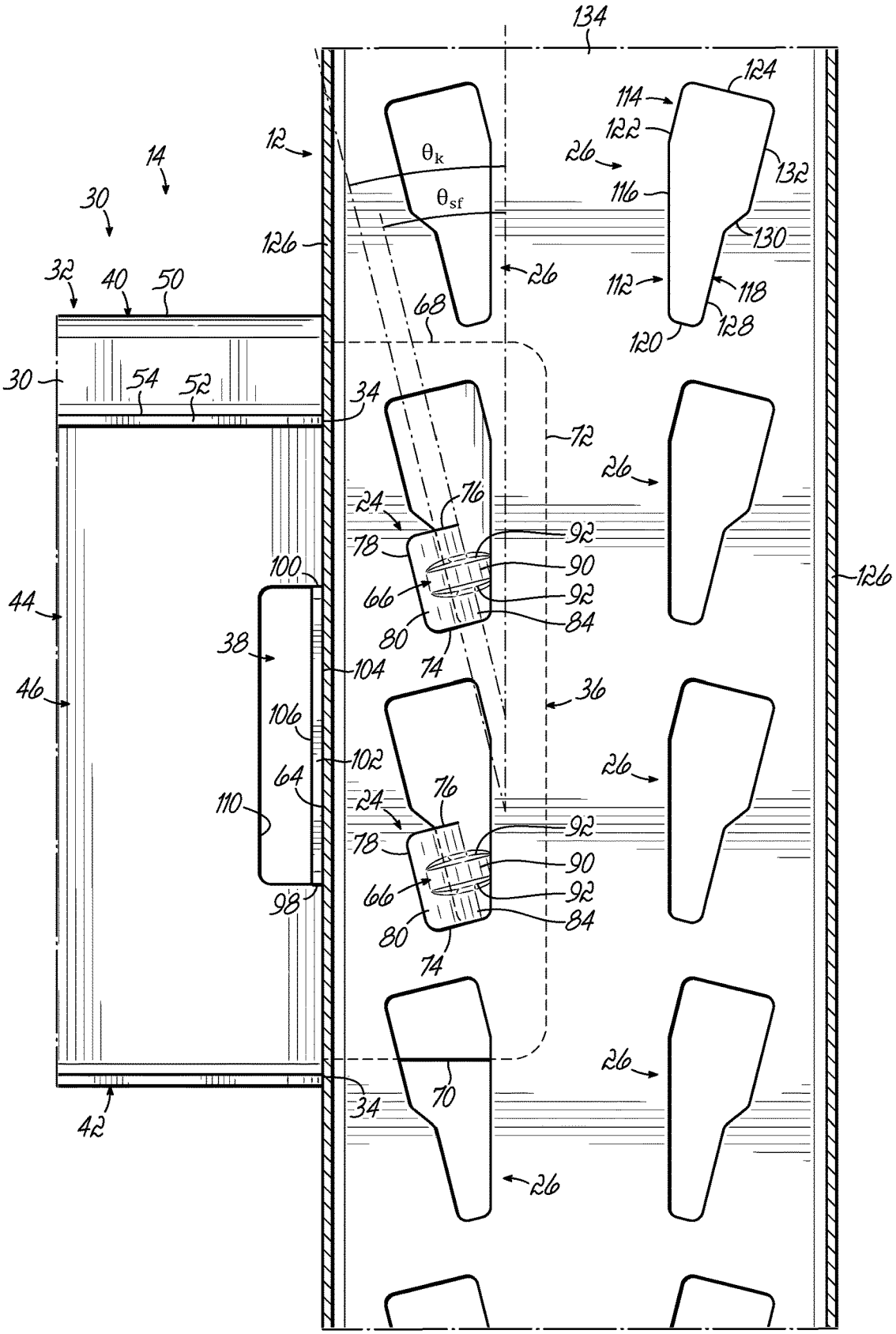
FIG. 12 is a partial cross-sectional view of a corner post of the exemplary shelving unit of FIG. 1, illustrating the engagement between a pair of securing fingers, an enforcement tab, and the corner post according to an embodiment of the invention.

FIG. 12 illustrates the second end 30 of the shelf support beam 14 engaged with a corner post 12 of the shelving unit 10. When so positioned, each securing finger 24 is received within a respective keyhole 26 to position the enforcement tab 38 in an abutting or near abutting relationship with the inwardly facing surface 64 of the corner post 12. As shown, each keyhole 26 includes a generally V-shaped portion 112 at one end that transitions to a generally rectangular-shaped portion 114 at the opposite end. The V-shaped portion 112 is defined by a vertical edge 116 and an angled edge 118 which meet at a base 120. The vertical edge 116 is parallel with a longitudinal axis of the corner post 12 and extends from the V-shaped portion 112 to the rectangle-shaped portion 114. At the transition to the rectangle-shaped portion 114, the vertical edge 116 transitions to an angled portion 122 that extends to a top edge 124 of the keyhole 26. The angled edge 118 extends from the V-shaped portion 112 to the rectangular-shaped portion 114 in a step-shaped manner and at an angle relative to the vertical edge 116. More particularly, the angled edge 118 is angled away from the vertical edge 116, in a direction toward a nearest sidewall 126 of the corner post 12, to define a keyhole angle $\theta_k$. The keyhole angle $\theta_k$ may be the same or substantially similar to the securing finger angle $\theta_{sf}$. Thus, the keyhole angle $\theta_k$ may be within a range of between 5° to 30°, for example. Preferably, the angle $\theta_k$ is within a range of between 10° to 20° and, in the embodiment shown, the angle $\theta_k$ is 12°.

The step-shaped configuration of the angled edge 118 defines a base portion 128, a shoulder 130, and a top portion 132 of the angled edge 118. The base portion 128 forms part of the V-shaped portion 112 of the keyhole 26 and transitions to the top portion 132 via the shoulder 130. The top portion 132 forms part of the rectangle-shaped portion 114 of the keyhole 26. The base portion 128 and the top portion 132 may have the same angle $\theta_k$ relative to the vertical edge 116. The rectangle-shaped portion 114 of the keyhole 26 may be defined by the top portion 132 of the angled edge 118, the top edge 124, and the angled portion 122 of the vertical edge 116. The V-shaped portion 112 may be defined by the shoulder 130 and base portion 128 of the angled edge 118, the radiused base 120, and the vertical edge 116. The V-shaped portion 112 is configured to receive a corresponding securing finger 24 for coupling the shelf support beam 14 to the corner post 12, as described in further detail below.

With continued reference to FIG. 12, each tab 36 is configured to engage with a front wall 134 (i.e., the outwardly facing surface 62 of the front wall 134) of the corner post 12 while the abutment edges 34 and enforcement tab 38 are configured to engage with the sidewall 126 (i.e., the inwardly facing surface 64 of the sidewall 126) of the corner post 12 to couple the shelf support beam 14 to the corner post 12. As shown, the front wall 134 of each corner post 12 includes the keyholes 26. The engagement between the tabs 36, abutment edges 34, enforcement tab 38, and corresponding corner posts 12 is maintained as a result of the engagement between each securing finger 24 and corresponding keyhole 26, as will be described in further detail below.

To couple the shelf support beam 14 to the corner post 12, as shown in FIG. 12, the securing fingers 24 are first received through the rectangle-shaped portion 114 of each respective keyhole 26. Once the securing fingers 24 are received within each keyhole 26, the shelf support beam 14 may be lowered until the base edge 74 of each securing finger 24 engages with the base 120 of each respective keyhole 26. When so positioned, as shown, the angled portion 128 of each keyhole 26 and part of corner post 12 are received within the pocket 88 of each respective securing finger 24. More particularly, each securing finger 24 is engaged with the radiused base 120 and the angled portion 128 of each keyhole 26, and extends between the radiused base 120 and the shoulder 130. As the securing fingers 24 are seated in respective keyholes 26, the enforcement tab 38 is brought into engagement with the sidewall 126 of the corner post 12. When the securing fingers 24 are fully seated within the keyholes 26, as shown, the sidewall 126 is pressed into engagement with the outer surface 104 of the enforcement tab 38.

The angled engagement between the securing fingers 24 and the keyholes 26 causes a friction fit between the enforcement tab 38, abutment edges 34, and the sidewall 126 of the corner post 12 to prevent the shelf support beam 14 from being inadvertently uncoupled from the corner post 12. The weight of the shelf support beam 14, shelf 22, and any items supported thereon, generate a force in a downward direction on the support beam 14 that acts to further maintain the engagement between each securing finger 24 and corresponding keyhole 26. Moreover, the engagement between each tab 36 and each front wall 134, and each enforcement tab 38 and each sidewall 126 of the corner posts 12 counteracts any torsional forces acting on the beam 14 that would cause the securing fingers 24 to disengage with the keyholes 26. To this end, the tab 36, which has a height similar to a height of the web 42 of the structural member 32, improves the performance and load carrying capacity of the shelf support beam 14.

Figure 13:
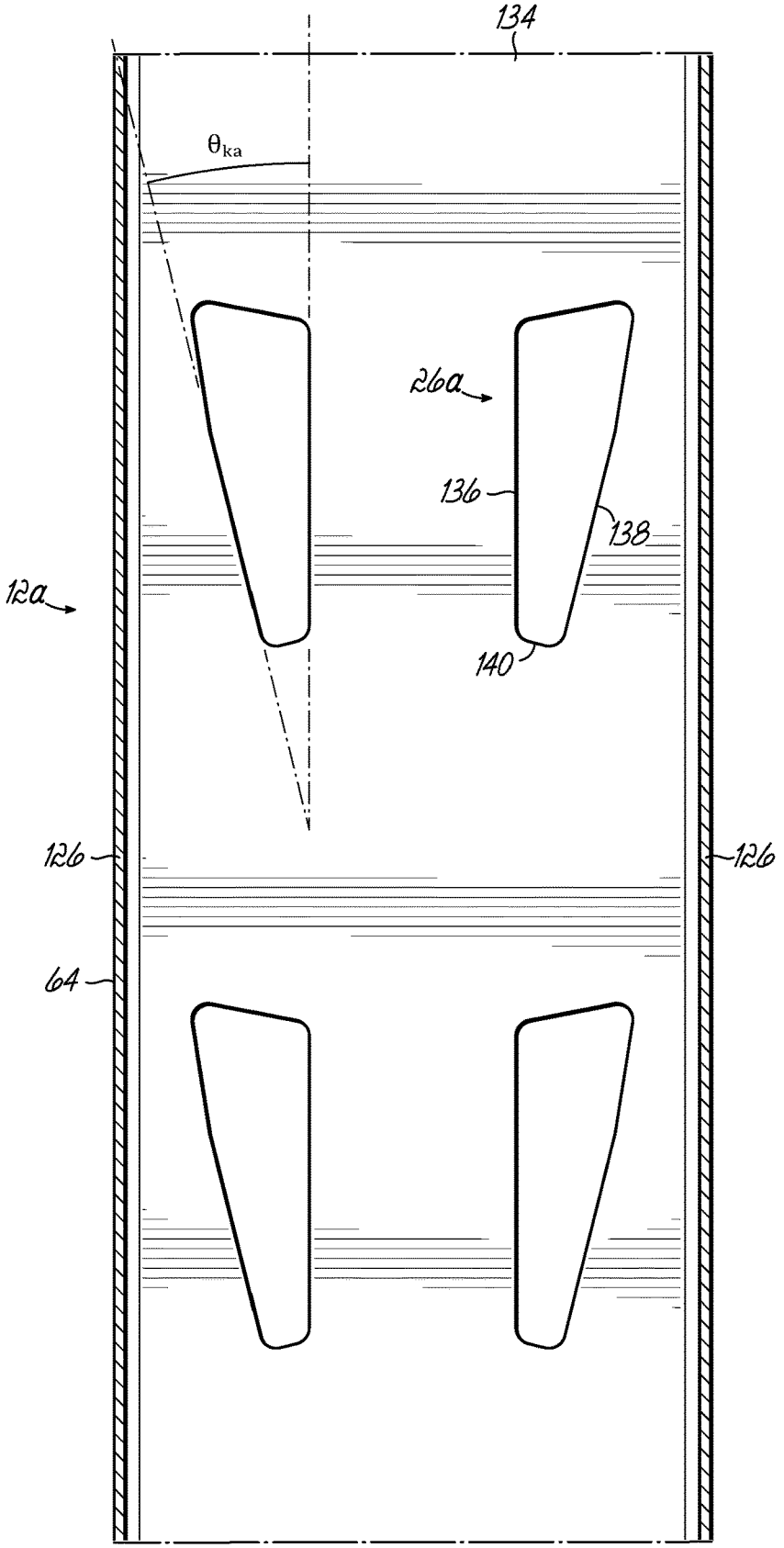
FIG. 13 is a partial cross-sectional view of a corner post for use with the shelving unit of FIG. 1 in accordance with another embodiment of the invention.

FIG. 13 illustrates a corner post **12*a* having pairs of V-shaped keyholes 26*a* distributed along a length of the corner post 12*a* in accordance with another embodiment of the invention. The corner post 12*a* is similar in many respects to the embodiment of the corner post 12 previously described and shown with regard to FIGS. 1-12, and thus like numerals represent like features. The primary difference between the corner post 12*a* of this embodiment and the corner post 12 of the above-described embodiment is the configuration of the keyholes 26*a*. In this regard, the keyholes 26*a* are distributed along the length of the corner post 12*a* in a manner similar to the keyholes 26 described above. However, the keyholes 26*a* have a different shape to facilitate coupling of the shelf support beam 14 to the corner post 12*a***, as will be described in further detail below.

As shown in FIG. 13, each keyhole **26*a* has a generally vertical edge 136 and an angled edge 138 which meet at a base 140. Together, the vertical edge 136 and angled edge 138 define a generally V-shaped configuration of each keyhole 26*a*. In this regard, the angled edge 138 is angled relative to the vertical edge 136 to define a keyhole angle $\theta_{ka}$. Like the embodiment described above with respect to FIG. 12, the keyhole angle $\theta_{ka}$ may be the same or substantially similar to the securing finger angle $\theta_{sf}$ of each securing finger 24. Thus, the keyhole angle $\theta_{ka}$ may be within a range of between 5° to 30°, for example. Preferably, the angle $\theta_{ka}$ is within a range of between 10° to 20° and, in the embodiment shown, the angle $\theta_{ka}$ is 12° for each keyhole 26*a***.

To couple the shelf support beam 14 to the corner post **12*a*, the securing finger 24 is first received through a widest part of the V-shaped keyhole 26*a* (e.g., where a distance between the vertical edge 82 and angled edge 84 is the greatest). Once the securing fingers 24 are received within respective keyholes 26*a*, the shelf support beam 14 may be lowered until the base edge 74 of each securing finger 24 engages with the corresponding base 140** of each keyhole 26*a*. When so positioned, the angled edge 138 and part of corner post 12*a* are received within the pocket 88 of each corresponding securing finger 24. To this end, the weight of the shelf support beam 14, shelf 22, and any items support thereon, generate a force in a downward direction on the support beam 14 that acts to maintain the engagement between each securing finger 24 and corresponding keyhole 26*a*. Further, the engagement between each tab 36 and each outwardly facing surface 58 of the corner posts 12*a* counteracts any torsional forces acting on the beam 14 that would cause the securing fingers 24 to disengage with the keyhole 26*a*.

Figure 15:
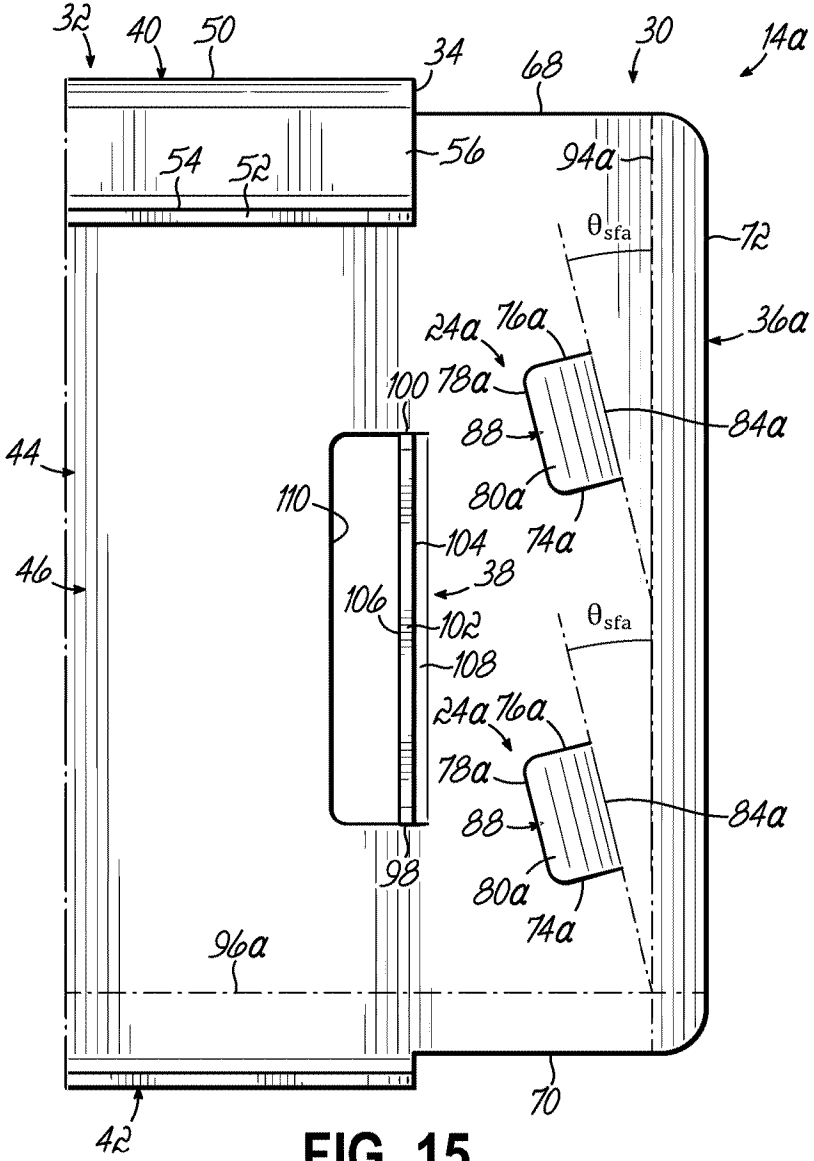
FIG. 15 is plan view of a back side of a first end of the shelf support beam of FIG. 14.
Figure 14:
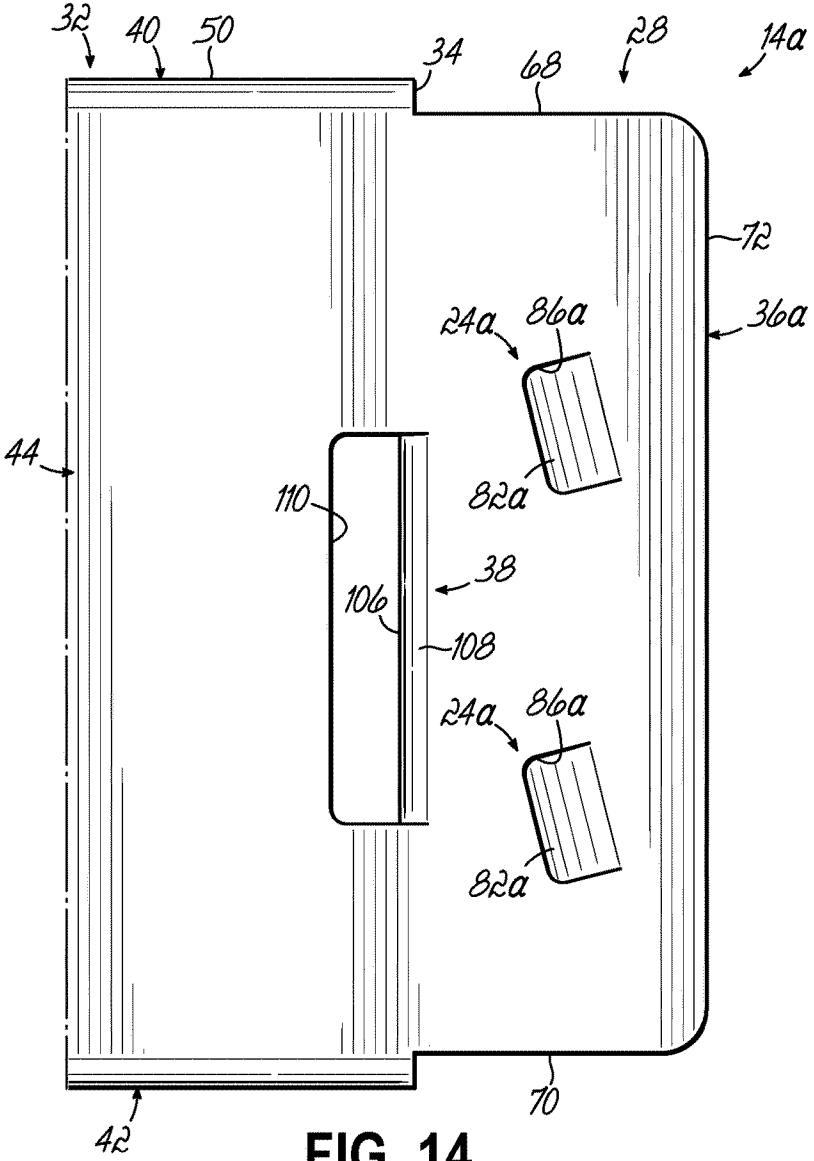
FIG. 14 is plan view of a front side of a second end of a shelf support beam according to another embodiment of the invention.

With reference to FIGS. 14-15, details of a horizontal shelf support beam 14*a* are shown in accordance with another embodiment of the present invention. The shelf support beam 14*a* is similar in many respects to the shelf support beam 14 described above with respect to FIGS. 1-12 and therefore like numerals represent like features. The primary difference between the shelf support beam 14*a* of this embodiment and the shelf support beam 14 of the above-described embodiment is that the securing fingers 24*a* are formed without a stiffening rib 66. To this end, the support beam 14*a* includes the structural member 32 having a C-shaped cross-sectional configuration, and therefore those details of the support beam 14*a* will not be redescribed for purposes of brevity.

As shown in FIGS. 14-15, the tab 36*a* includes a pair of securing fingers 24*a* and an enforcement tab 38 like the embodiment of the support beam 14 described above with respect to FIGS. 1-12. Each securing finger 24*a* is punch-formed so as to be partially cut from the tab 36 and bent inwardly (i.e., in a direction toward to the enforcement tab 38 formed by the beam 14*a*) to form the shape of the securing finger 24*a*. In that regard, each securing finger 24*a* has a generally rectangle-shaped profile and includes a base edge 74*a*, a top edge 76*a*, a distal edge 78*a*, an outer surface 80*a*, and an inner surface 82*a*. The inner and outer surfaces 82*a*, 80*a* are curved such that each securing finger 24*a* has an S-shaped cross-section. To this end, as each securing finger 24*a* is punch-formed without a stiffening rib 66, the inner and outer surfaces 82*a*, 80*a* are generally planar as they extend from the bend line 84*a* to the distal edge 78*a* of the securing finger 24*a*. Forming of the securing finger 24*a* results in a rectangle-shaped aperture 86*a* being formed in the tab 36*a* beneath the inner surface 82*a* of each finger 24*a*.

As shown in FIG. 15, the bend line 84*a* of each securing finger 24*a* is angled relative to a plane axis 94*a* disposed perpendicular to a longitudinal axis 96*a* of the shelf support beam 14*a* such that the entirety of each securing finger 24*a* is angled inwardly toward a center of the structural member 32 and the enforcement tab 38. The angled relationship between the bend lines 84*a* and the axis 94*a* defines a securing finger angle $\theta_{sfa}$ for each securing finger 24*a*. The securing finger angle $\theta_{sfa}$ may be the same or different for each securing finger 24*a*. In either case, the securing finger angle $\theta_{sfa}$ for each securing finger 24*a* may be within a range of between 5° to 30°, for example. Preferably, the angle $\theta_{sfa}$ is within a range of between 10° to 20° and, in the embodiment shown, the securing finger angle $\theta_{sfa}$ is 11° for each securing finger 24*a*.

Figure 17:
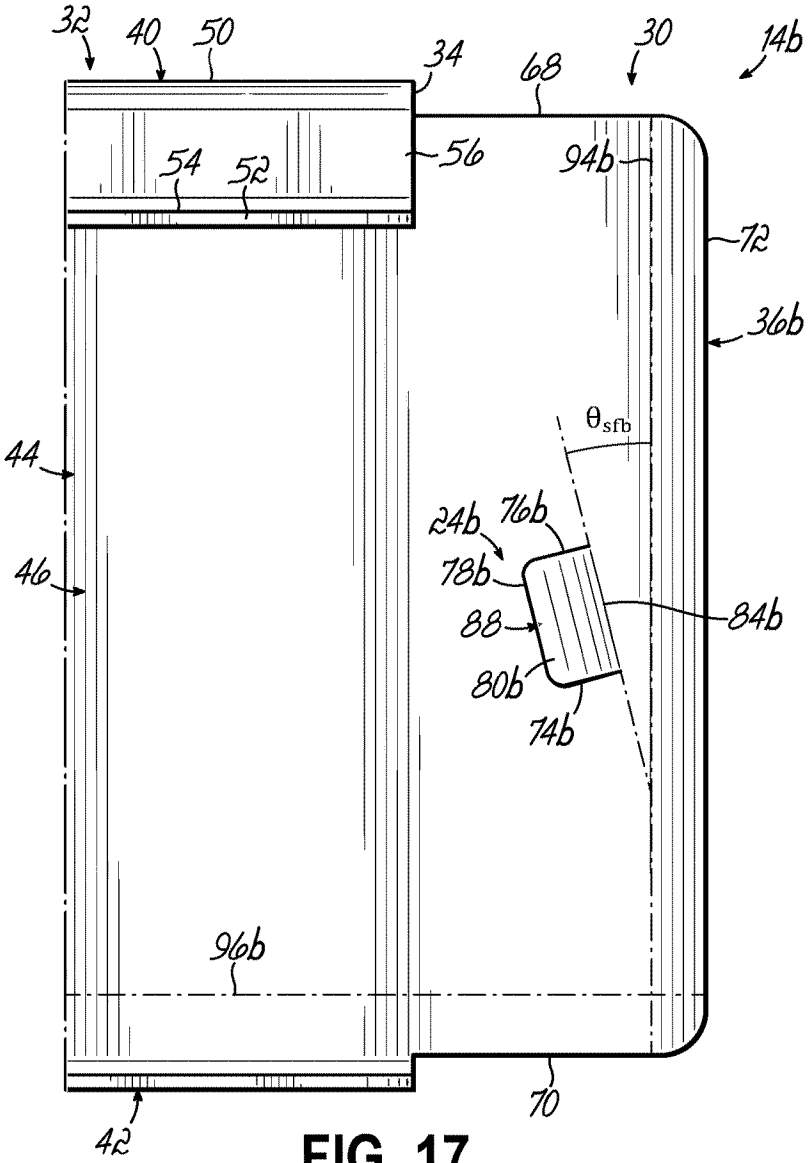
FIG. 17 is plan view of a back side of a first end of the shelf support beam of FIG. 14.
Figure 16:
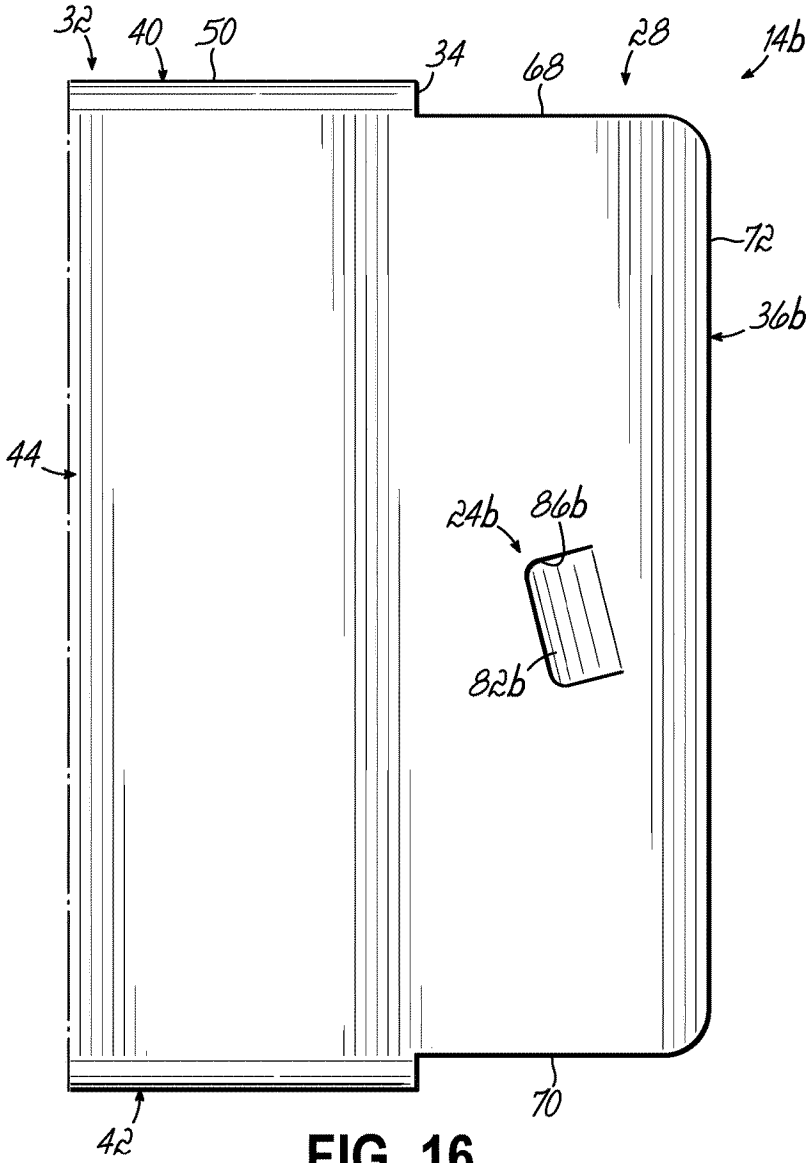
FIG. 16 is plan view of a front side of a second end of a shelf support beam according to another embodiment of the invention.
Figure 18:
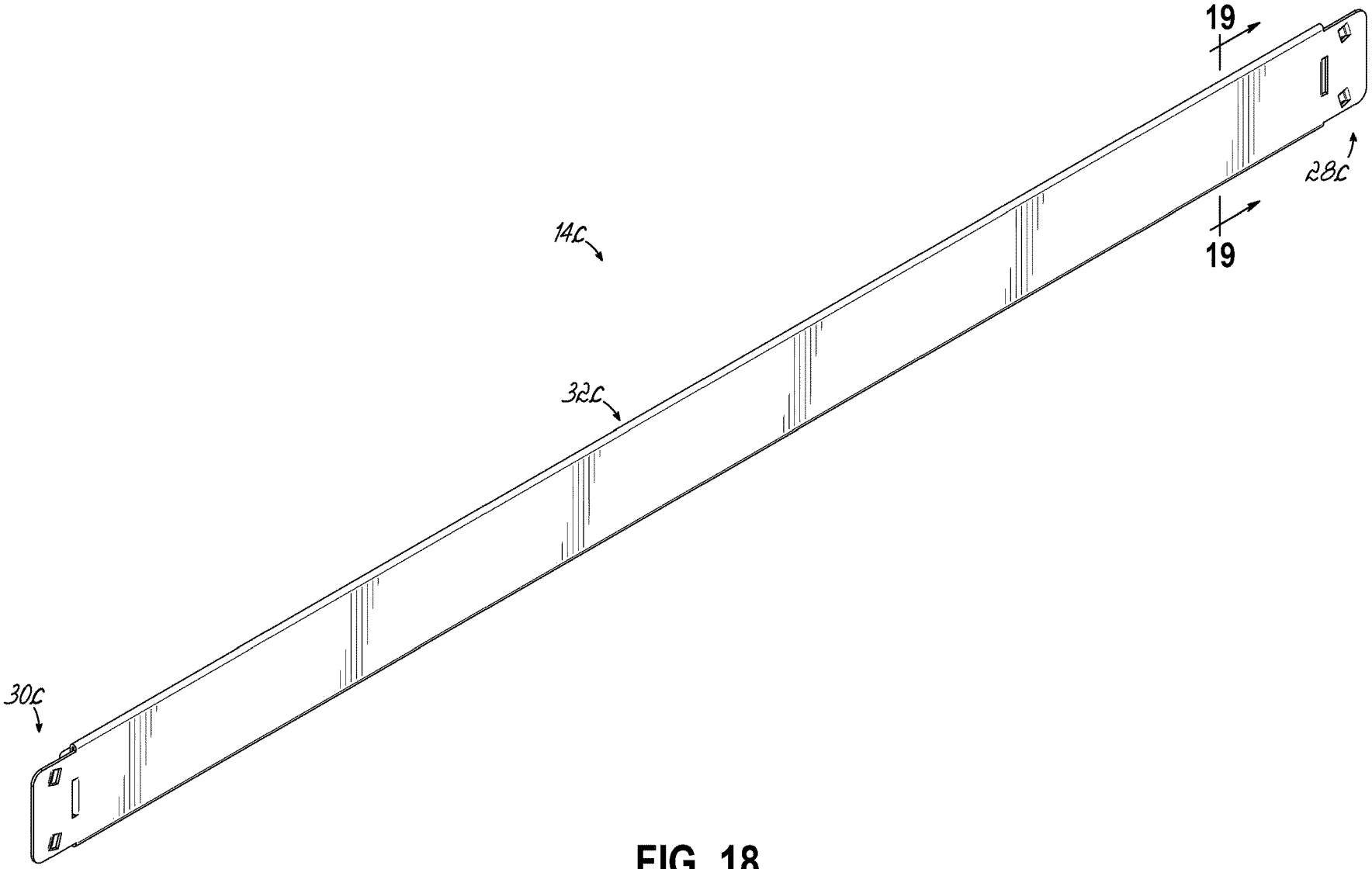
FIG. 18 is a perspective view of a front side of a shelf support beam according to another embodiment of the invention.

With reference to FIGS. 16-17, details of a horizontal shelf support beam 14*b* are shown in accordance with another embodiment of the present invention. The shelf support beam 14*b* is similar in many respects to the shelf support beam 14 described above with respect to FIGS. 1-12 and therefore like numerals represent like features. The primary difference between the shelf support beam 14*b* of this embodiment and the shelf support beam 14 of the above-described embodiment is that the shelf support beam 14*b* includes only one securing finger 24*b* formed without a stiffening rib 66. While not shown, in an alternative embodiment, each securing finger 24*b* may include a stiffening rib 66 that is formed in each finger 24*b* during punch-forming of the securing finger 24*b*. In either case, the support beam 14*b* includes the structural member 32 having a C-shaped cross-sectional configuration, and therefore those details of the support beam 14*b* will not be redescribed for purposes of brevity.

As shown, the securing finger 24*b* is centrally located on the tab 36*b* and is punch-formed so as to be partially cut from the tab 36*b* and bent inwardly to form the shape of the securing finger 24*b*. In that regard, the securing finger 24*b* may have a same thickness as the tab 36*b*. More particularly, the securing finger 24*b* has a generally rectangle-shaped profile and includes a base edge 74*b*, a top edge 76*b*, a distal edge 78*b*, an outer surface 80*b*, and an inner surface 82*b*. The inner and outer surfaces 82*b*, 80*b* are curved such that each securing finger 24*b* has an S-shaped cross-section. To this end, as each securing finger 24*b* is punch-formed without a stiffening rib 66, the inner and outer surfaces 82*b*, 80*b* are generally planar as they extend from the bend line 84*b* to the distal edge 78*b* of the securing finger 24*b*. Forming of the securing finger 24*b* results in a rectangle-shaped aperture 86*b* being formed in the tab 36*b* beneath the inner surface 82*b* of each finger 24*b*.

As shown in FIG. 17, the bend line 84*b* of the securing finger 24*b* is angled relative to a plane 94*b* disposed perpendicular to a longitudinal axis 96*b* of the shelf support beam 14*b* such that the entirety of the securing finger 24*b* is angled inwardly toward a center of the structural member 32. The angled relationship between the bend line 84*b* and the axis 94*b* defines a securing finger angle $\theta_{sfb}$ for the securing finger 24*b*. The securing finger angle $\theta_{sfb}$ for the securing finger 24*b* may be within a range of between 5° to 30°, for example. Preferably, the angle $\theta_{sfb}$ is within a range of between 10° to 20° and, in the embodiment shown, the securing finger angle $\theta_{sfb}$ is 11° for the securing finger 24*b*.

With reference to FIGS. 18-25, wherein like numerals represent like features relative to the shelf support beam 14 described above with respect to FIGS. 1-12, for example, details of a horizontal shelf support beam 14*c* are shown in accordance with another embodiment of the present invention. The primary differences between the shelf support beam 14*c* of this embodiment and the shelf support beam 14 of the above-described embodiment is the configuration of the structural member 32*c*, tabs 36*c*, securing fingers 24*c*, and enforcement tabs 38*c*, each of which will be described in further detail below.

Similar to the shelf support beam 14 of the embodiment described with respect to FIGS. 1-12, the shelf support beam 14*c* includes a first end 28*c* and a second end 30*c* located at opposite longitudinal ends of the shelf support beam 14*c* between which the structural member 32*c* extends. The generally C-shaped structural member 32*c* is partially truncated near each of the first and second ends 28*c*, 30*c* to define abutment edges 34*c* of the structural member 32*c* as well as the plate-like tabs 36*c* at each end 28*c*, 30*c* of the shelf support beam 14*c*. The plate-like tabs 36*c* each extend a distance, in a longitudinal direction, from each corresponding abutment edge 34*c* of the structural member 32*c*. Compared to the tabs 36 of the above-described embodiment, the tabs 36*c* of this embodiment extend a greater distance from each corresponding abutment edge 34*c* of the structural member 32*c*. That way, each tab 36*c* has a larger surface area to engage with the corner post 12 when mounted thereto. To this end, each tab 36*c* includes a pair of punch-formed securing fingers 24*c* for securing ends 28*c*, 30*c* of the shelf support beam 14*c* to corresponding corner posts 12 of the shelving unit 10, and an enforcement tab 38*c*.

Figure 19:
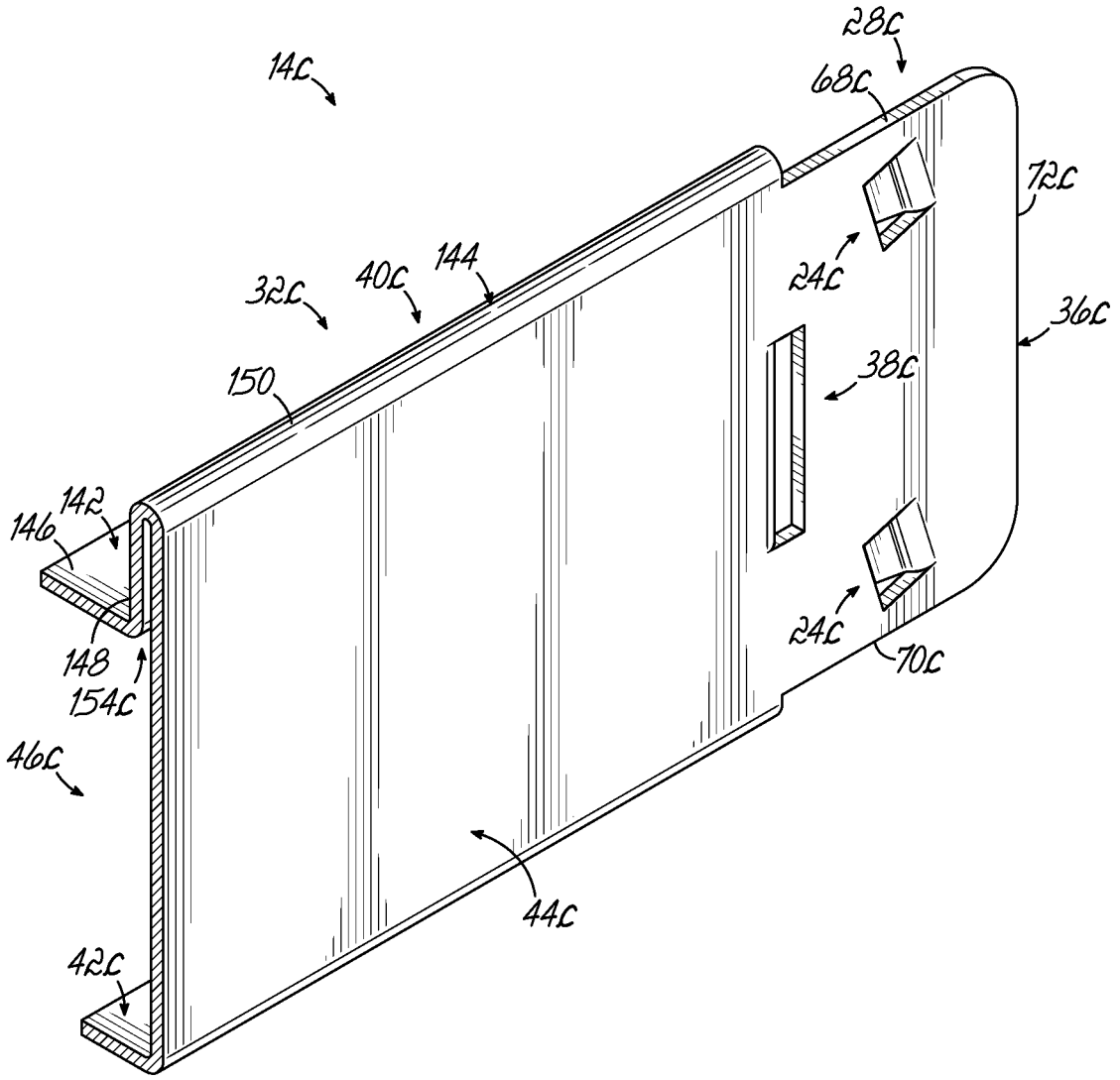
FIG. 19 is a cross-sectional view of the shelf support beam of FIG. 2 taken along line 19-19, illustrating a first end of the shelf support beam.
Figure 20:
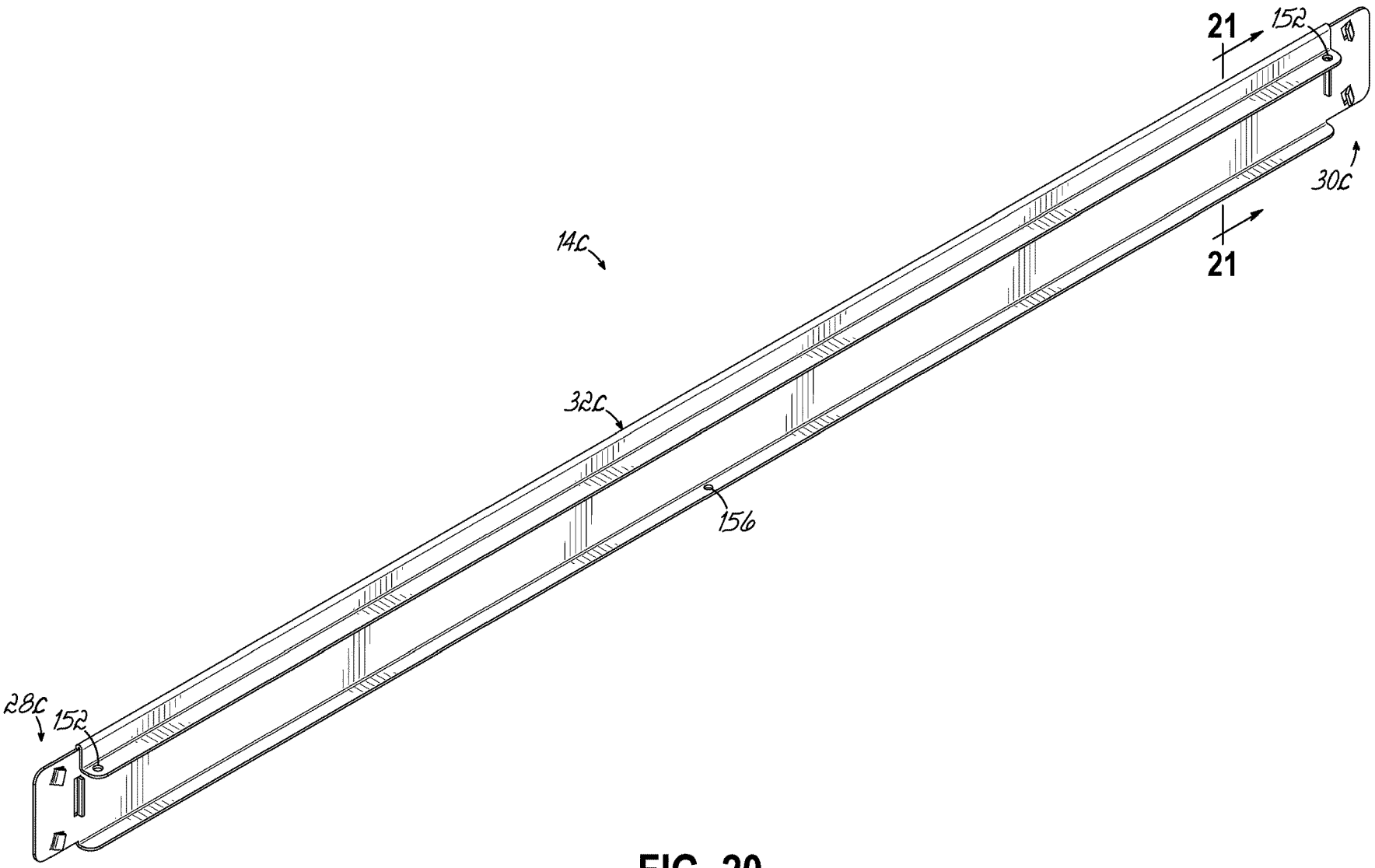
FIG. 20 is a perspective view of a back side of the shelf support beam of FIGS. 18-19.
Figure 21:
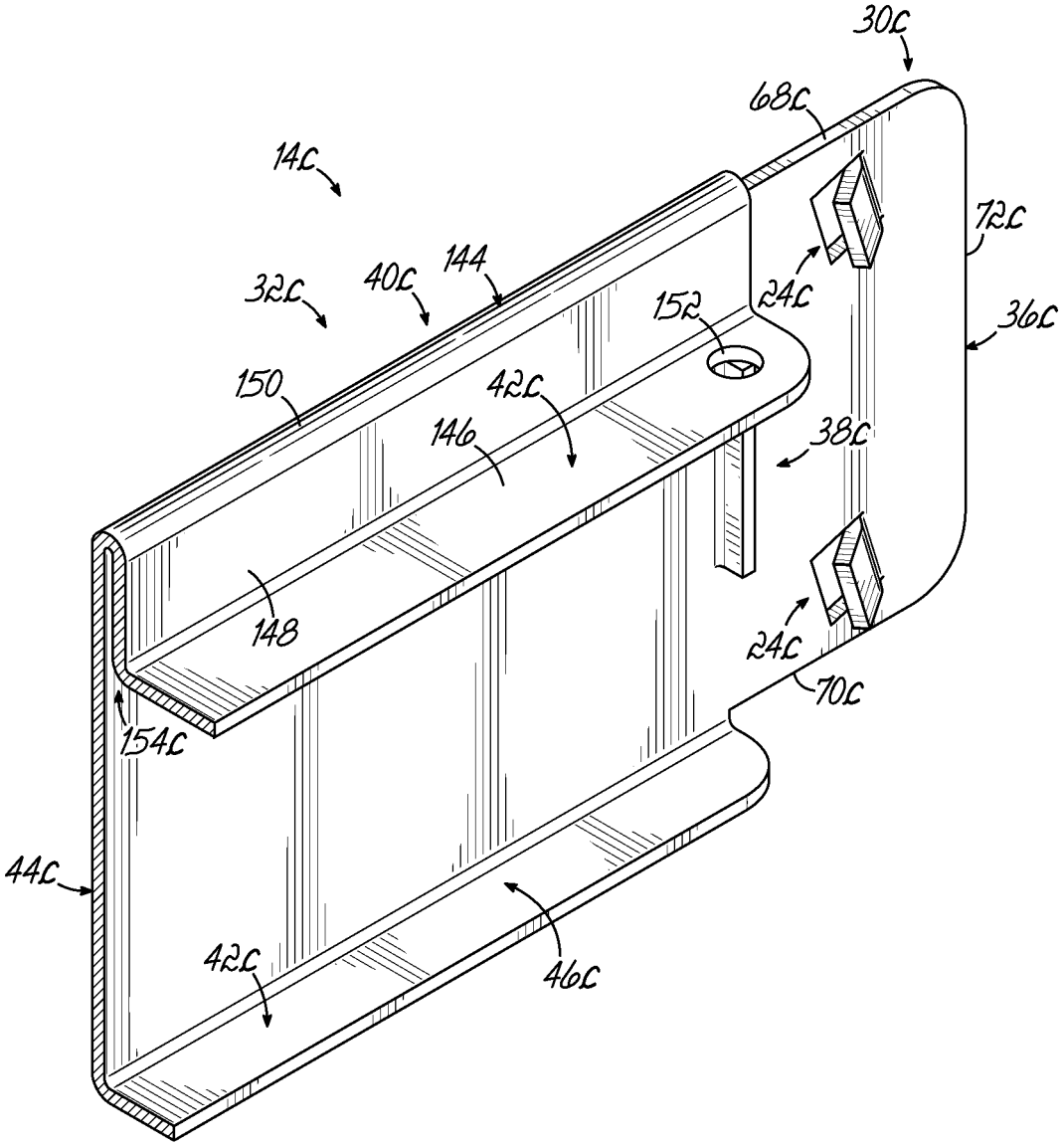
FIG. 21 is a cross-sectional view of the shelf support beam of FIG. 20 taken along line 21-21, illustrating a second end of the shelf support beam.
Figure 23:
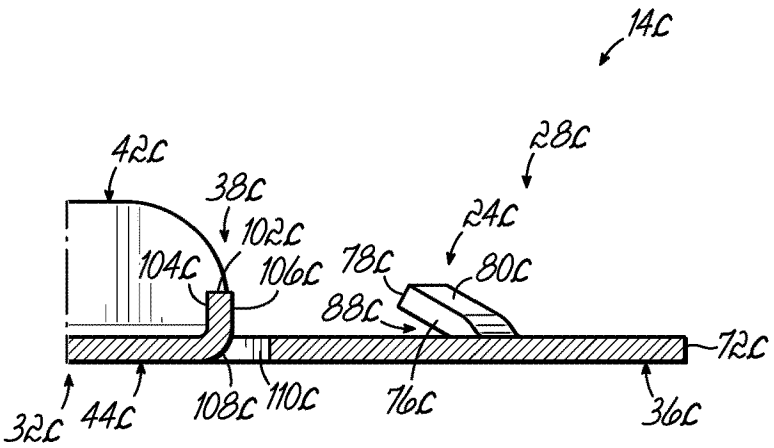
FIG. 23 is a cross-sectional view of the shelf support beam taken along line 23-23 of FIG. 22.
Figure 22:
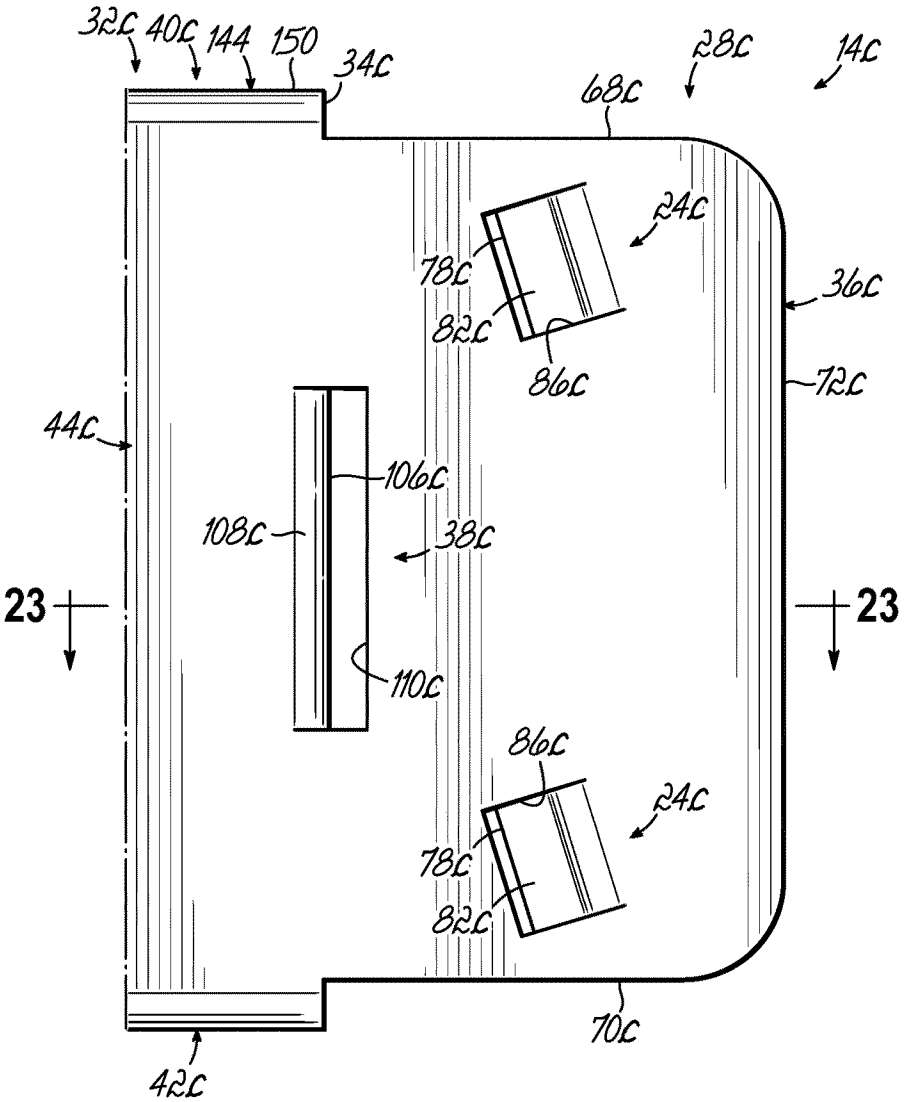
FIG. 22 is plan view of the front side of the first end of the shelf support beam of FIGS. 18-21.

With reference to FIGS. 19-21, the structural member 32*c* has a C-shaped cross-sectional configuration and includes a top flange 40*c* and a bottom flange 42*c* between which a web 44*c* extends. The web 44*c* forms a vertical portion of the structural member 32*c* during use. Collectively, the web 44*c*, top flange 40*c*, and bottom flange 42*c* form the C-shape of the structural member 32*c* and further define a channel 46*c* that extends a length of the structural member 32*c*. The web 44*c* may be radiused at each of the locations at which the structural member 32*c* transitions to the top flange 40*c* and to the bottom flange 42*c*. The top flange 40*c* is configured to receive a shelf and extends generally inwardly in a shelving unit and in a direction away from the web 44*c*. The top flange 40*c* has an L-portion 142 and a cap portion 144. The L-shaped portion 142 includes a lower portion 146 and a sidewall portion 148, and the cap portion 144 is rounded to transition from the web 44*c* to the sidewall portion 148 to define a top edge 150 of the structural member 32*c*. The sidewall portion 148 transitions from the cap portion 144 to the lower portion 146 to provide the L-shaped configuration. The lower portion 146 may have one or more bores 152 located therein with at least one bore 152 being located near each end 28*c*, 30*c* of the shelf support beam 14*c* (e.g., FIG. 20). In any event, the lower portion 146 is configured to support a shelf thereon with the sidewall 148 providing a stop for lateral movement of the shelf in an outward direction (i.e., toward the web 44*c*) in a shelving unit. To this end, a gap 154*c* between the sidewall 148 and the web 44*c* of the shelf support beam 14*c* is smaller compared to a gap 154 between the sidewall 54 and the web 42 of the embodiment of the shelf support beam 14 previously described with respect to FIGS. 1-12. Thus, the shelf support beam 14*c* may be configured to support a shelf having a different width, for example. As a result of the smaller configuration of the gap 154*c*, the shelf support beam 14*c* may have a smaller load bearing capacity compared to the shelf support beam 14 of the previously described embodiment. For example, the shelf support beam 14*c* may have a load bearing capacity of 1000 lbs.

With continued reference to FIGS. 19-21, the bottom flange 42*c* joins the web 44*c* on an opposite end of the web 44*c* from the top flange 40*c*. The bottom flange 42*c* includes at least one aperture 156 located at a central position along the bottom flange 42*c* (e.g., FIG. 20). The at least one aperture 156 is configured to receive a tie member, such as a wire tie clip, used to increase the load capacity of the shelving units. More particularly, the tie clip are configured to create a positive connection between the shelves 22 and the support beams 14*a*.

As shown in FIGS. 18-25, each tab 36*c* is an extension of the web 44*c* at each end 28*c*, 30*c* of the shelf support beam 14*c*. In that regard, each tab 36*c* includes and end edge 72*c*, an upper edge 68*c*, and a lower edge 70*c*. Each end 28*c*, 30*c* of the shelf support beam 14*c* includes two securing fingers 24*c* which are spaced apart a distance along a height of the tab 36*c* (e.g., a distance between an upper edge 68*c* and a lower edge 70*c* of the tab 36*c*). In that regard, one securing finger 24*c* is located closer to the upper edge 68*c* of the tab 36*c* with the other securing finger 24*c* being located closer to the lower edge 70*c* of the tab 36*c*. The securing fingers 24*c* of this embodiment are located closer to the respective edges 68*c*, 70*c* of the tab 36*c* compared to the previously described embodiment. The ends 28*c*, 30*c* of the shelf support beam 14*c* also include a respective enforcement tab 38*c* which is located between the top flange 40*c* and the bottom flange 42*c* of the structural member 32*c* so as to be generally in-line (or co-planar) with the abutment edges 34*c* (e.g., FIG. 24). While the enforcement tab 38*c* of the embodiment is located on the web 44*c*, the enforcement tab 38*c* is punch-formed such that the aperture 110*c* is located on the tab 36*c*, as will be described in further detail below.

Figure 25:
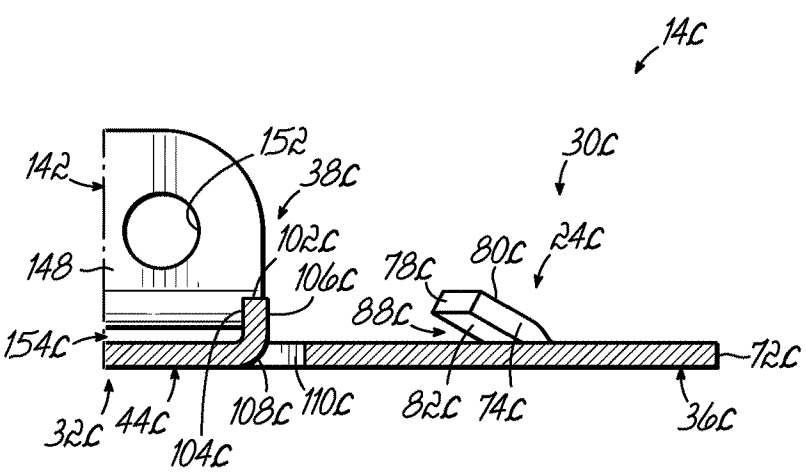
FIG. 25 is a cross-sectional view of the second end of the shelf support beam taken along line 25-25 of FIG. 24.

With reference to FIGS. 21-25, each securing finger 24*c* has a generally rectangle-shaped profile and includes a base edge 74*c*, a top edge 76*c*, a distal edge 78*c*, an outer surface 80*c*, and an inner surface 82*c*. As best shown in FIG. 25, the inner and outer surfaces 82*c*, 80*c* of each securing finger 24*c* are planar for most their length to provide each securing finger 24*c* with a generally rectangular cross-sectional profile. In this regard, each securing finger 24*c* is generally plate-like and projects from a bend line 84*c* on the tab 36*c*, in a direction toward the enforcement tab 38*c*, to the distal edge 78*c* which is spaced a distance away from the tab 36*c*. Forming of the securing finger 24*c* results in a rectangle-shaped aperture 86*c* being formed in the tab 36*c* beneath the inner surface 82*c* of each finger 24*c*. To this end, the space between the inner surface 82*c* of each finger 24*c* and the respective aperture 86*c* in the tab 36*c* defines a pocket 88*c*. The pocket 88*c* is configured to face, or open towards the enforcement tab 38*c*, and may be V-shaped, for example. Like the previously described embodiment, when the shelf support beam 14*c* is engaged with the corner post 12, 12*a*, each securing finger 24*c* is engaged with a corresponding keyhole 26, 26*a* such that a portion of the corner post 12, 12*a* is received within each pocket 88*c*.

Figure 24:
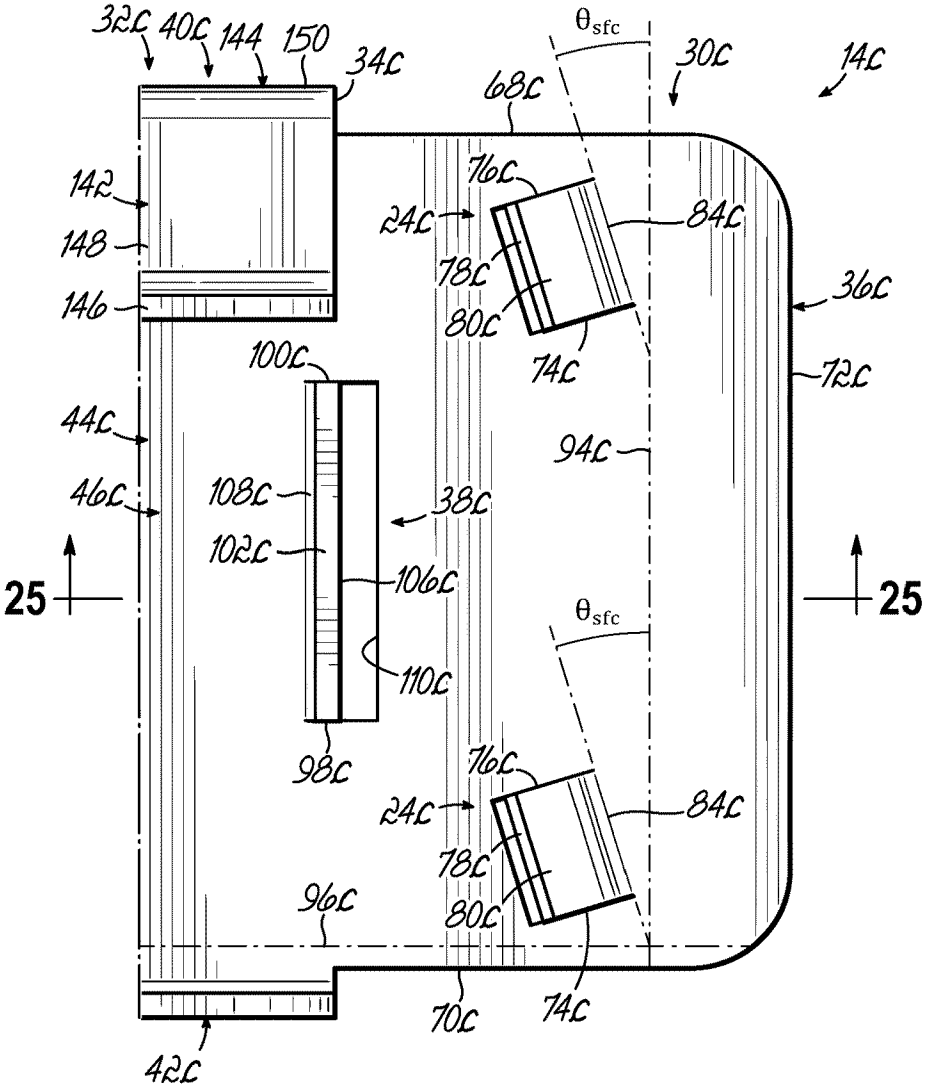
FIG. 24 is plan view of the back side of the second end of the shelf support beam of FIGS. 18-22.

Referring now to FIG. 24, the bend line 84*c* of each securing finger 24*c* is angled relative to a plane axis 94*c* disposed perpendicular to a longitudinal axis 96*c* of the shelf support beam 14*c* such that the entirety of each securing finger 24*c* is angled inwardly toward a center of the structural member 32*c* and the enforcement tab 38*c*. The angled relationship between the bend lines 84*c* and the axis 94*c* defines a securing finger angle $\theta_{sfc}$ for each securing finger 24*c*. The securing finger angle $\theta_{sfc}$ may be the same or different for each securing finger 24*c*. In any event, the securing finger angle $\theta_{sfc}$ for each securing finger 24*c* may be within a range of between 5° to 30°, for example. Preferably, the angle $\theta_{sfc}$ is within a range of between 10° to 20° and, in the embodiment shown, the securing finger angle $\theta_{sfc}$ is 11° for each securing finger 24*c*.

With reference to FIGS. 18-25, the enforcement tab 38*c* has a generally rectangle-shaped profile and includes a base edge 98*c*, a top edge 100*c*, a distal edge 102*c*, an outer surface 104*c*, and an inner surface 106*c*. The inner and outer surfaces 104*c*, 106*c* are generally planar such that the enforcement tab 38*c* has cross-section that is generally rectangular in shape. The enforcement tab 38*c* projects from a bend line 108*c* to the distal edge 102*c* so as to be generally perpendicular to the tab 36*c* and web 42*c*. Forming of the enforcement tab 38*c* results in the rectangle-shaped aperture 110*c* being formed in the tab 36*c*. To this end, the aperture 110*c* is located in a region of the tab 36*c* between the enforcement tab 38*c* and the pair of securing fingers 24*c*. Once formed, the enforcement tab 38*c* has a height defined by a distance between the bend line 108*c* and the distal edge 102*c*, and a length defined by a distance between the base edge 98*c* and the top edge 100*c*. Similar to the previously described embodiment, the enforcement tab 38*c* has a length that is greater than the height to maximize surface contact potential between the enforcement tab 38*c* and the post 12, 12*a* while limiting a width of the aperture 110*c* (e.g., a distance that the aperture 110*c* extends along the longitudinal axis 96*c* of the shelf support beam 14*c*). However, a height of the enforcement tab 38*c* may be generally equal to a height of the pair of securing fingers 24*c* (e.g., FIG. 25). A longitudinal axis of the enforcement tab 38*c* is generally perpendicular to the longitudinal axis 96*c* of the shelf support beam 14*c* and generally parallel with plane axis 94*c*.

With reference to FIGS. 22-25, each enforcement tab 38*c* is spaced away from the pair of securing fingers 24*c* so as to be located between the top flange 40*c* and the bottom flange 42*c* of the structural member 32*c*. More particularly, the enforcement tab 38*c* is generally centered on the web 44*c*, but is positioned closer to the top flange 40*c* compared to the bottom flange 42*c*. The positioning of the enforcement tab 38*c* is such that neither the top edge 100*c* of the enforcement tab 38*c* nor the base edge 98*c* opposes the securing fingers 24*c*. Rather, the top edge 100*c* terminates just below the base edge 74*c* of one securing finger 24*c* and the base edge 98*c* terminates just above the top edge 76*c* of the other securing finger 24*c*, as best shown in FIG. 24. Thus, the length of the enforcement tab 38*c* is generally less than the distance that the securing fingers 24*c* are spaced apart.

The enforcement tab 38*c* is positioned such that the outer surface 104*c* of the enforcement tab 38*c* is coplanar with the abutment edges 34*c* to engage with the corner post 12, 12*a*, similar to the embodiment described above. For example, to couple the shelf support beam 14*c* to the corner post 12, the securing fingers 24*c* are first received through the rectangle-shaped portion 114 of each respective keyhole 26. Once the securing fingers 24*c* are received within each keyhole 26, the shelf support beam 14*c* may be lowered until the base edge 74*c* of each securing finger 24*c* engages with the radiused base 120 of each respective keyhole 26. When so positioned, the angled portion 128 of each keyhole 26 and part of corner post 12 are received within the pocket 88*c* of each respective securing finger 24*c*. More particularly, each securing finger 24*c* is engaged with the radiused base 120 and the angled portion 128 of each keyhole 26, and extends between the radiused base 120 and the shoulder 130. As the securing fingers 24*c* are seated in respective keyholes 26, the enforcement tab 38*c* is brought into engagement with the sidewall 126 of the corner post 12. When the securing fingers 24*c* are fully seated within the keyholes 26, the sidewall 126 of the corner post 12 is pressed into a frictional engagement with the outer surface 104*c* of the enforcement tab 38*c*.

Figure 27:
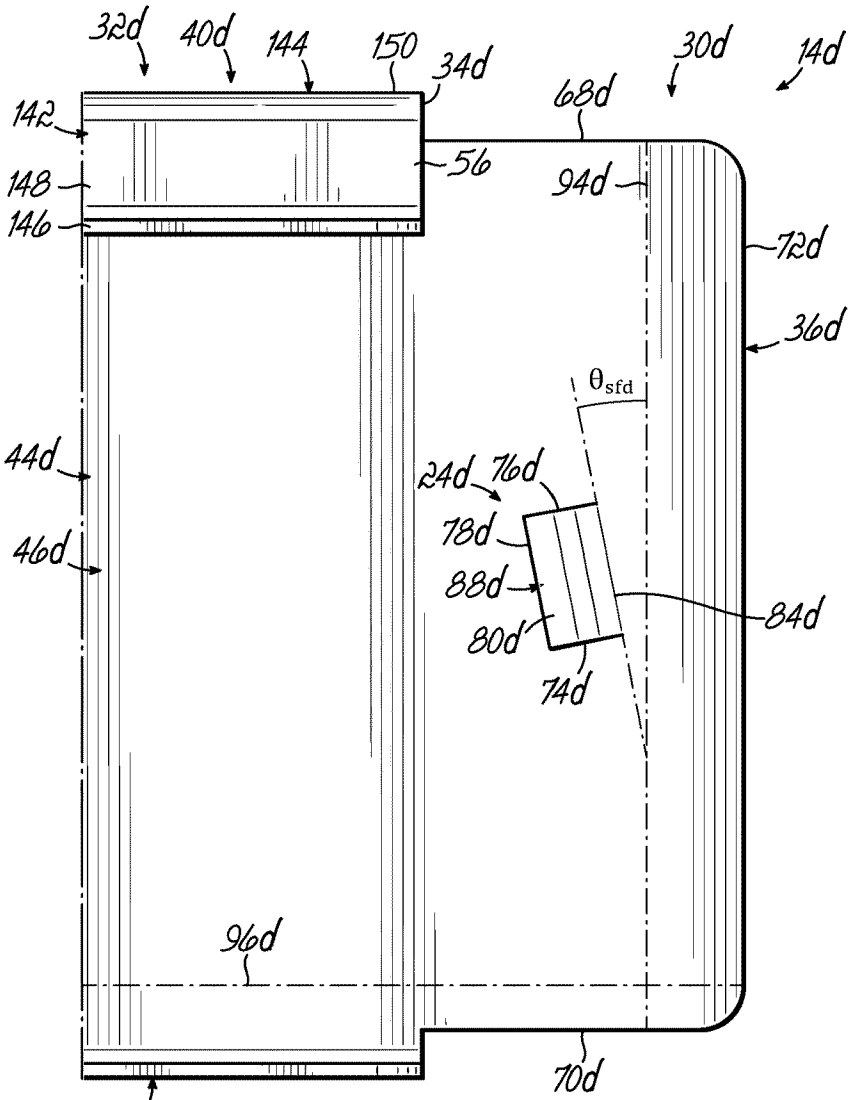
FIG. 27 is plan view of a back side of a first end of the shelf support beam of FIG. 26.
Figure 26:
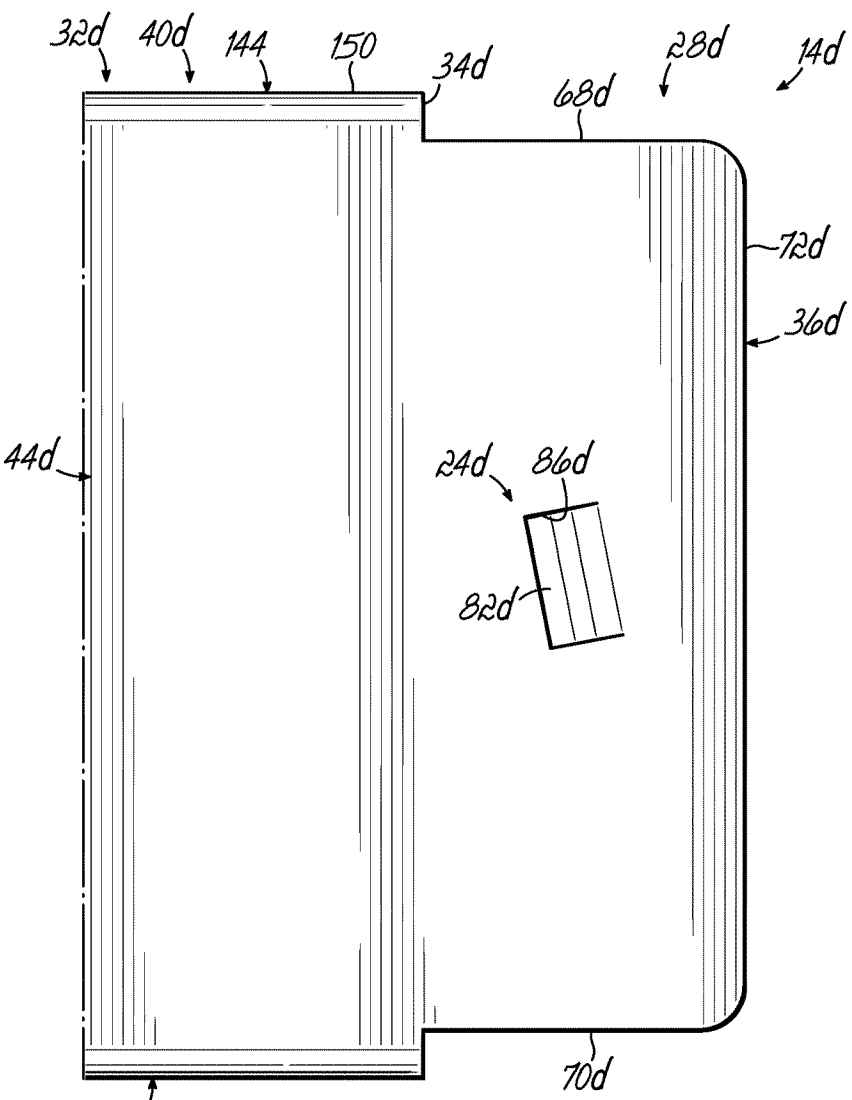
FIG. 26 is plan view of a front side of a second end of a shelf support beam according to another embodiment of the invention.
Figure 28:
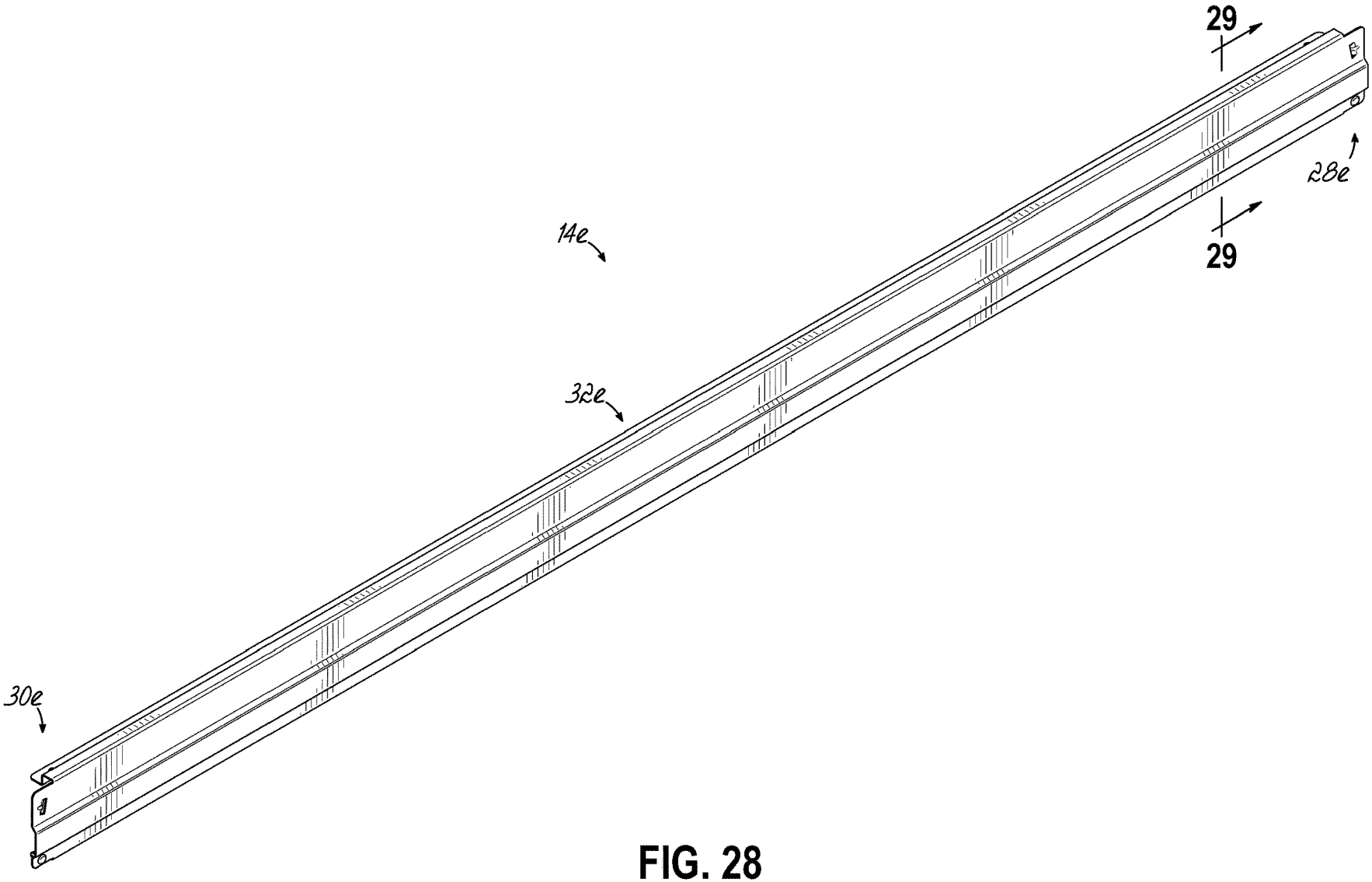
FIG. 28 is a perspective view of a front side of a shelf support beam according to another embodiment of the invention.
Figure 29:
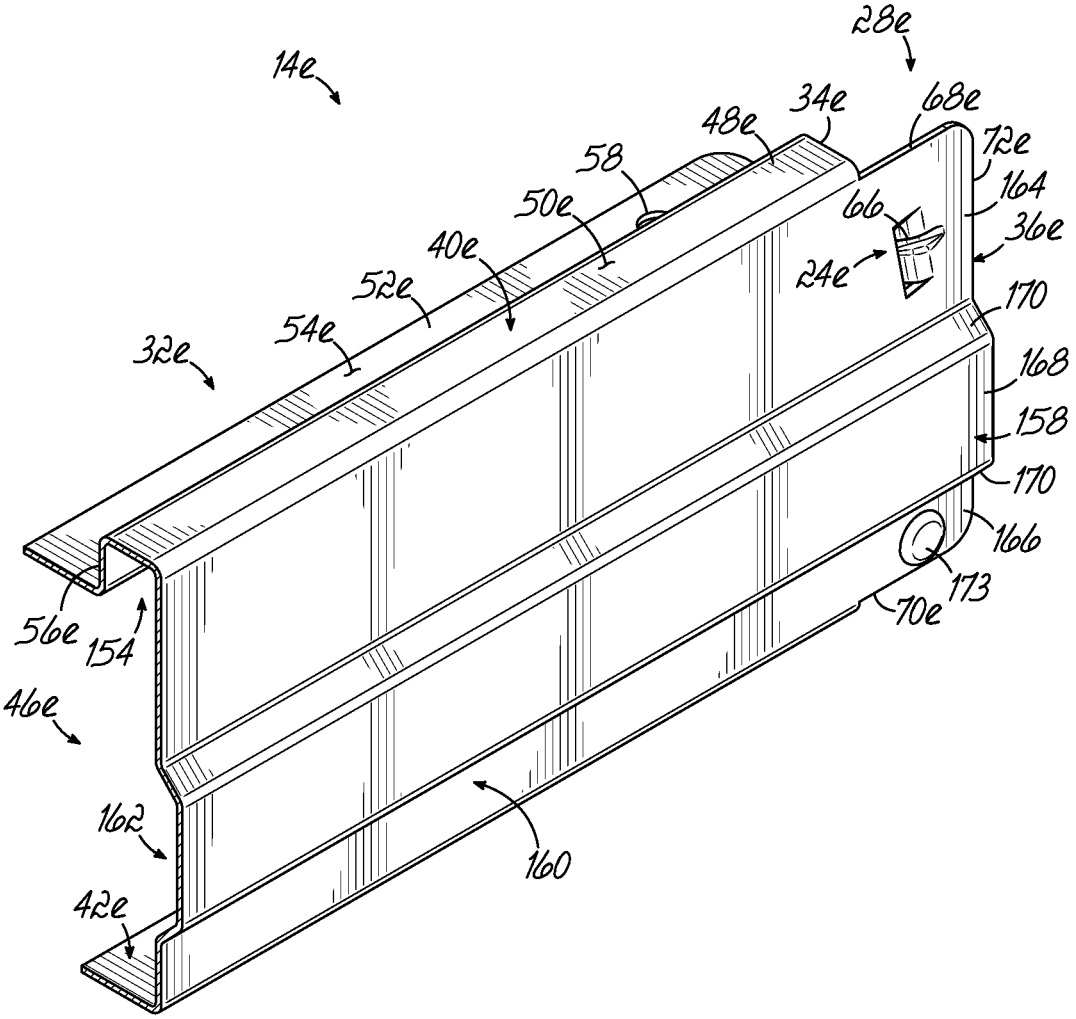
FIG. 29 is a cross-sectional view of the shelf support beam of FIG. 28 taken along line 29-29, illustrating a first end of the shelf support beam.
Figure 30:
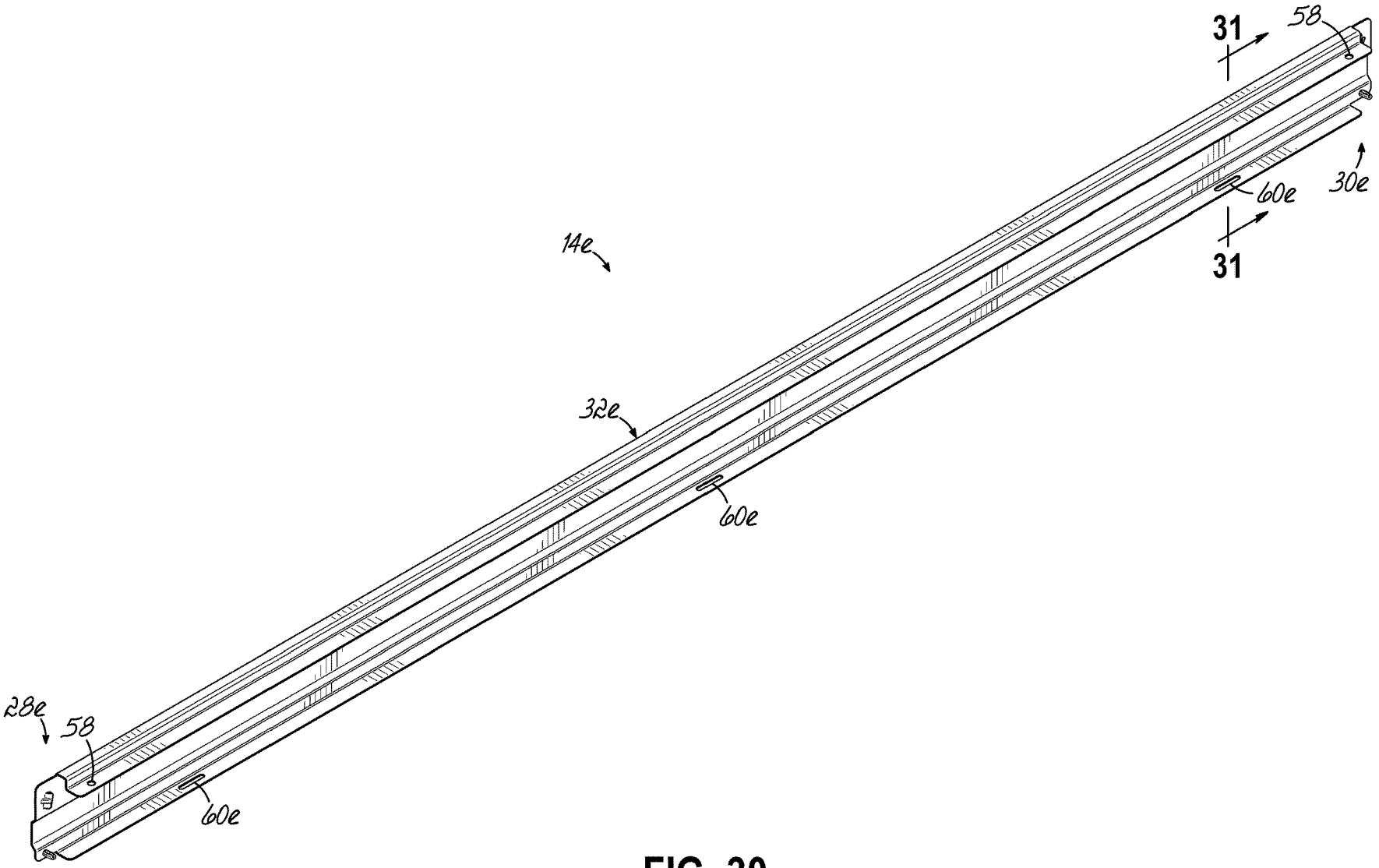
FIG. 30 is a perspective view of a back side of the shelf support beam of FIGS. 28-29.
Figure 31:
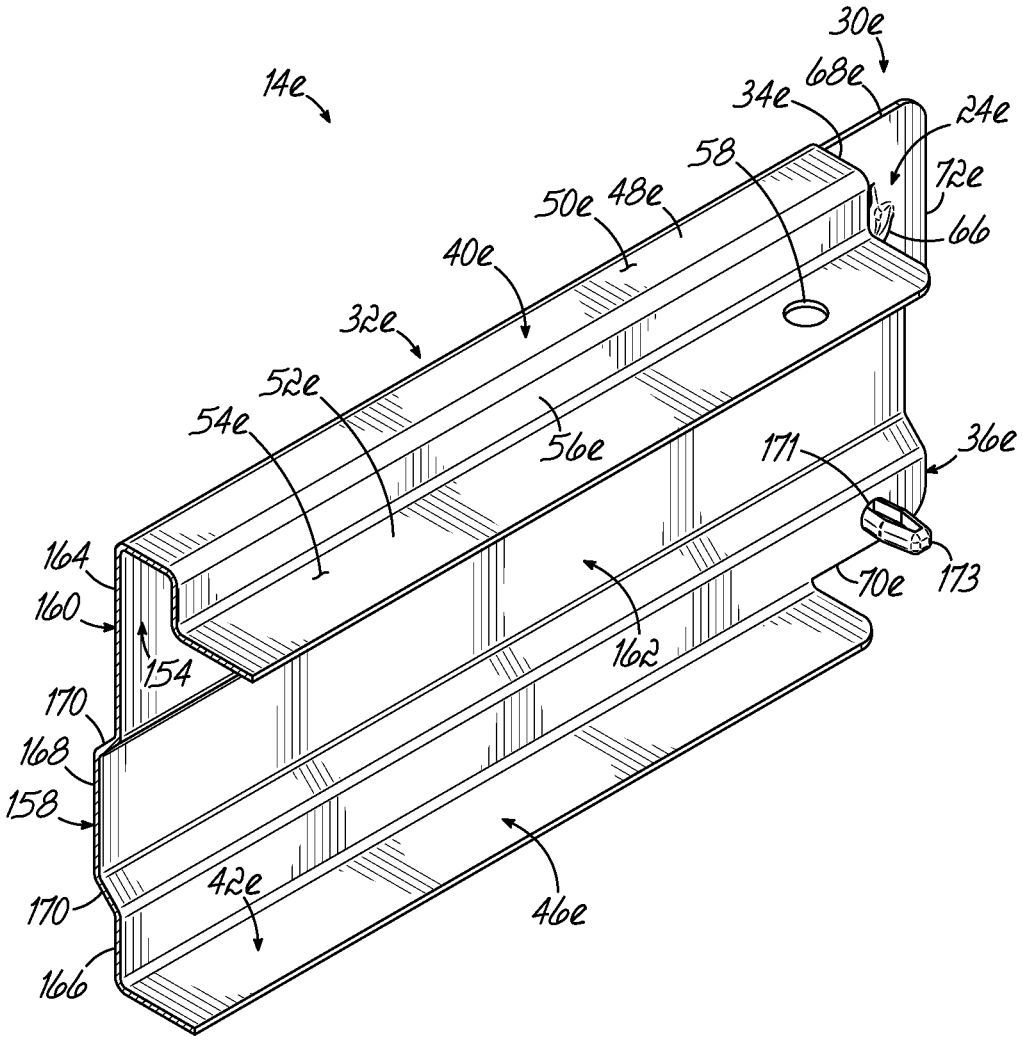
FIG. 31 is a cross-sectional view of the shelf support beam of FIG. 30 taken along line 31-31, illustrating a second end of the shelf support beam.
Figure 33:
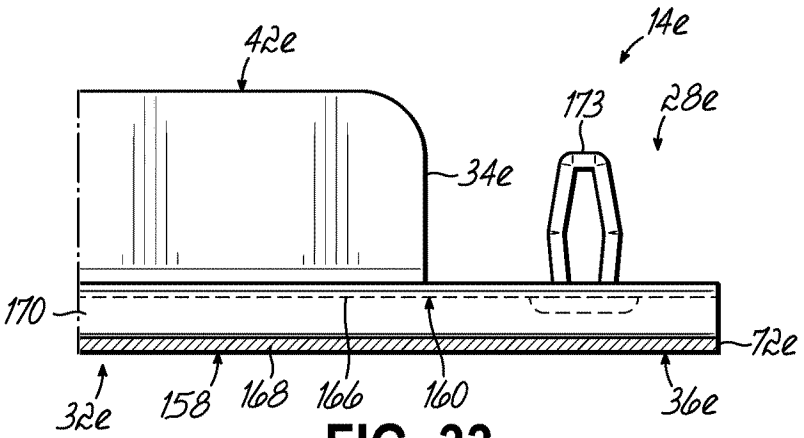
FIG. 33 is a cross-sectional view of the shelf support beam taken along line 33-33 of FIG. 32.
Figure 32:
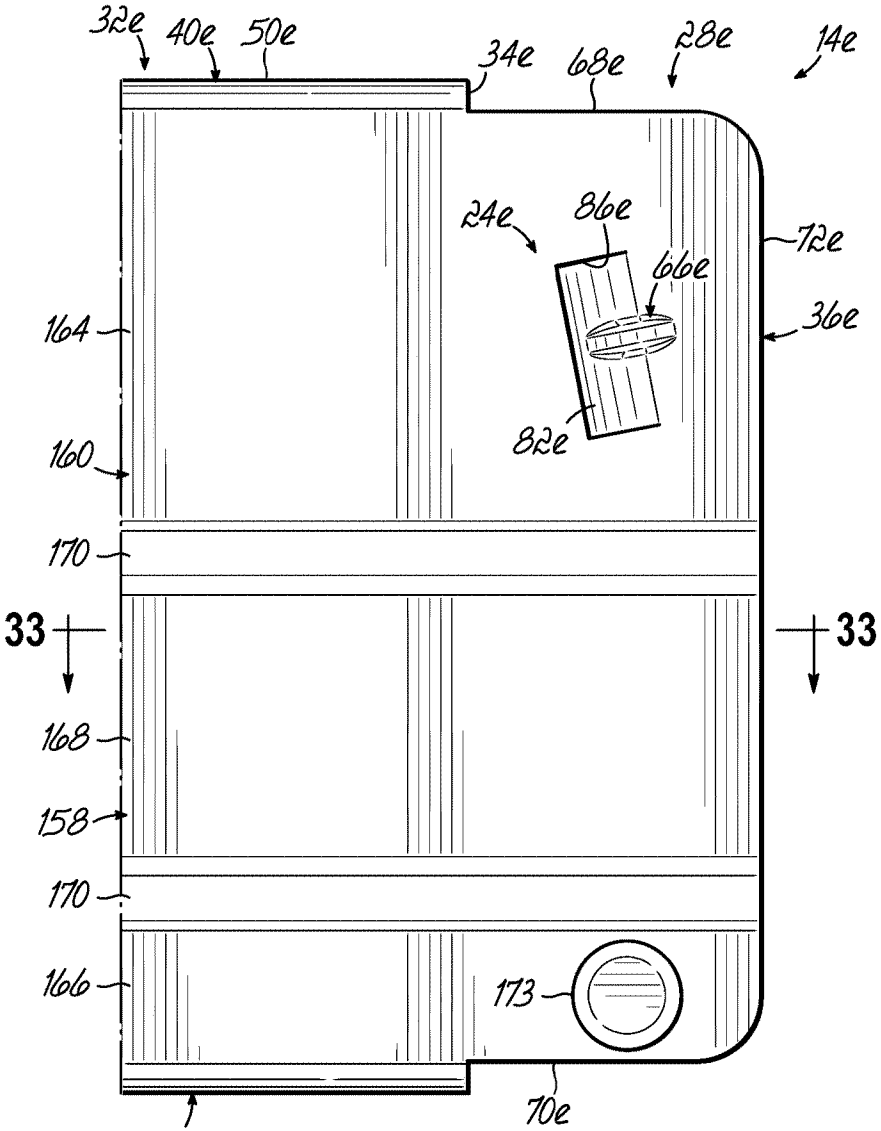
FIG. 32 is plan view of the front side of the first end of the shelf support beam of FIGS. 28-31.
Figure 35:
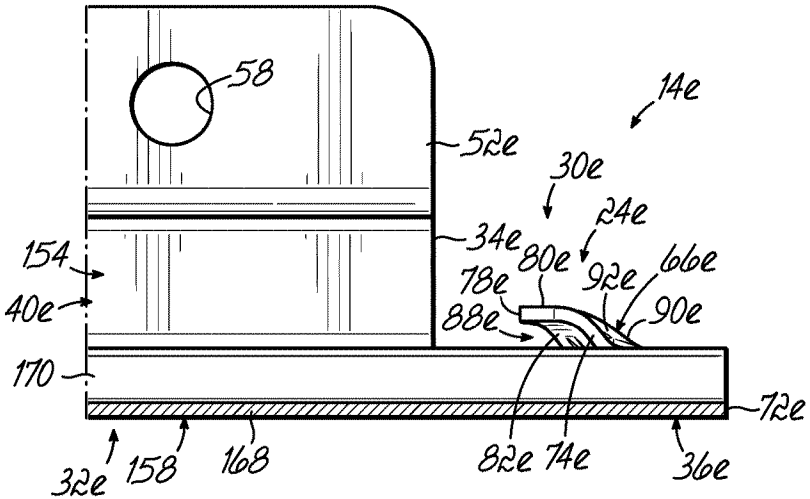
FIG. 35 is a cross-sectional view of the second end of the shelf support beam taken along line 35-35 of FIG. 34.

With reference to FIGS. 26-27, details of a horizontal shelf support beam 14*d* are shown in accordance with another embodiment of the present invention. The shelf support beam 14*d* is similar in many respects to the shelf support beam 14*c* described above with respect to FIGS. 18-25 and therefore like numerals represent like features. The primary difference between the shelf support beam 14*d* of this embodiment and the shelf support beam 14*c* of the above-described embodiment is that the shelf support beam 14*d* includes only one securing finger 24*d* formed in the tab 36*d* at each end 28*d*, 30*d* of the beam 14*d*. Also, each end 28*d*, 30*d* of the beam 14*d* does not include an enforcement tab 38*c*. It will also be understood that the support beam 14*d* includes the structural member 32*d* having a C-shaped cross-sectional configuration including top and bottom flanges 40*d*, 42*d* that define abutment edges 34*d*. To this end, the structural member 32*d* is similar to the structural member 32*c* described above with respect to FIGS. 18-25, and therefore additional details of the support beam 14*d* will not be redescribed for purposes of brevity.

With reference to FIGS. 26-27, each securing finger 24*d* is spaced away from edges 68*d*, 70*d*, 72*d* of each tab 36*d* so as to be centrally located on each corresponding tab 36*d*. More particularly, each securing finger 24*d* is punch-formed so as to extend generally inwardly in the shelving unit 10 and in a direction toward the channel 46*d*. As each securing finger 24*d* is punch-formed, each securing finger 24*d* is partially cut from each tab 36*d* and bent inwardly to form the shape of the securing finger 24*d*. In this regard, each securing finger 24*d* may have a same thickness as the corresponding tab 36*d*.

As shown, the securing finger 24*d* has a generally square shaped profile and includes a base edge 74*d*, a top edge 76*d*, a distal edge 78*d*, an outer surface 80*d*, and an inner surface 82*d*. The inner and outer surfaces 82*d*, 80*d* are generally planar for most their length such that the securing finger 24*d* has a rectangular cross-sectional shape. The securing finger 24*d* projects from a bend line 84*d* on the tab 36*d* to the distal edge 78*d* which is spaced a distance away from the tab 36*d*. Forming of the securing finger 24*d* results in a square shaped aperture 86*d* being formed in the tab 36*d* beneath the inner surface 82*d* of the securing finger 24*d*. To this end, the space between the inner surface 82*d* of the finger 24*d* and the aperture 86*d* of the tab 36*d* defines a pocket 88*d*. The pocket 88*d* may be V-shaped. Like the previously described embodiment, when the shelf support beam 14*d*, and more particularly the securing finger 24*d*, is engaged with the corner post 12, the pocket 88*d* is configured to receive a portion of the corner post 12 therein.

As best shown in FIG. 27, the bend line 84*d* of the securing finger 24*d* is angled relative to a plane axis 94*d* disposed perpendicular to a longitudinal axis 96*d* of the shelf support beam 14*d* such that the entirety of the securing finger 24*d* is angled inwardly toward a center of the structural member 32*d*. In this regard, the top edge 76*d* of the securing finger 24*d* is positioned closer to the structural member 32*d* compared to the base edge 74*d* of the securing finger 24*d*. The angled relationship between the bend line 84*d* and the axis 94*d* defines a securing finger angle $\theta_{sfd}$. In this regard, the securing finger angle $\theta_{sfd}$ may be within a range of between 5° to 30°, for example. Preferably, the angle $\theta_{sfd}$ is within a range of between 10° to 20° and, in the embodiment shown, the securing finger angle $\theta_{sfd}$ is 11°. To this end, while the securing finger 24*d* of one end of the shelf support beam 14*d* has been described in detail, it is understood that the securing finger 24*d* of the other end of the support beam 14*d* is similarly configured.

With reference to FIGS. 28-37, wherein like numerals represent like features compared to the shelf support beam 14 described above with respect to FIGS. 1-12, for example, details of a horizontal shelf support beam 14*e* are shown in accordance with another embodiment of the present invention. In many respects, the shelf support beam 14*e* is similar to the embodiment of the shelf support beam 14 previously described and shown with respect to FIGS. 1-12. The primary differences between the shelf support beam 14*e* of this embodiment and the shelf support beam 14 of the above-described embodiment is the configuration of the structural member 32*e*, tabs 36*e*, and securing fingers 24*e*. More particularly, the structural member 32*e* includes an embossed portion 158 to increase the load bearing capacity of the shelf support beam 14*e*.

With reference to FIGS. 28-31, the shelf support beam 14*e* includes a first end 28*e* and a second end 30*e* located at opposite longitudinal ends of the shelf support beam 14*e* between which a structural member 32*e* that is formed in a generally C-shape extends. The structural member 32*e* and the beam 14*e* have a longitudinal axis 96*e*. The generally C-shaped structural member 32*e* is partially truncated near each of the first and second ends 28*e*, 30*e* to define abutment edges 34*e* of the structural member 32*e* as well as tabs 36*e* at each end 28*e*, 30*e* of the shelf support beam 14*e*. The tabs 36*e* each extend a distance, in a longitudinal direction, from each corresponding abutment edge 34*e* of the structural member 32*e*. Each tab 36*e* includes one punch-formed securing finger 24*e* for securing ends 28*e*, 30*e* of the shelf support beam 14*e* to corresponding corner posts 12 of the shelving unit 10, as will be described in further detail below.

Figure 37:
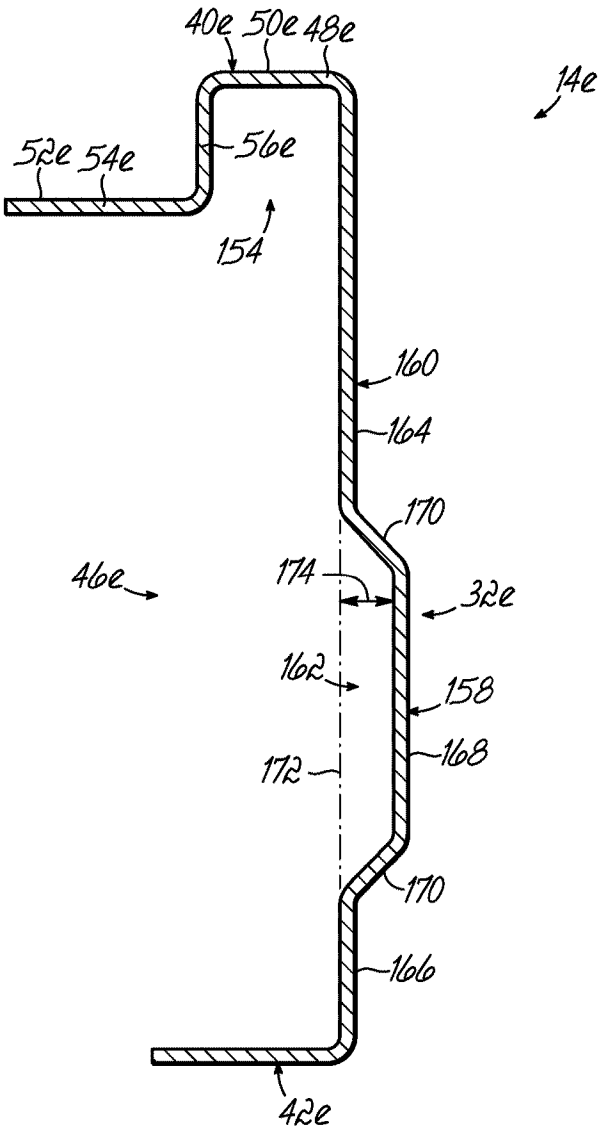
FIG. 37 is a cross-sectional view of the shelf support beam of FIGS. 28-35.
Figure 36:
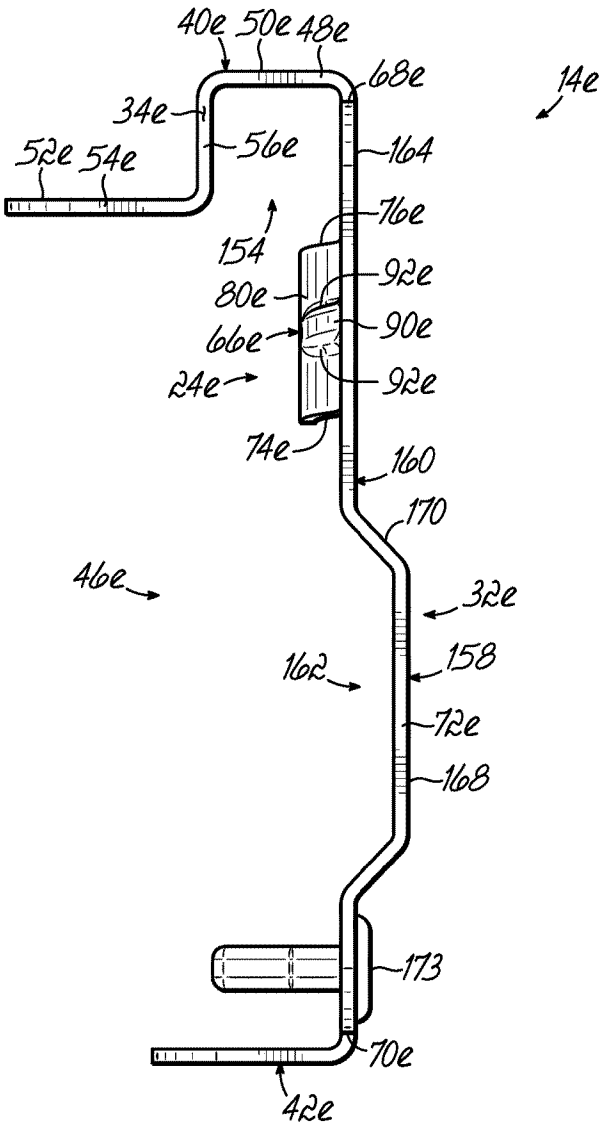
FIG. 36 is an end view of the shelf support beam of FIGS. 28-35.

With reference to FIGS. 36-37, the structural member 32*e* has a C-shaped cross-sectional configuration and includes a top flange 40*e* and a bottom flange 42*e* between which a middle portion 160, or web, of the structural member 32*e* extends. The middle portion 160 of the structural member 32*e* includes the embossed portion 158. Collectively, the middle portion 160, top flange 40*e*, and bottom flange 42*e* form the C-shape of the structural member 32*e* and further define a first channel 46*e* that extends a length of the structural member 32*e*. As will be described in further detail below, the embossed portion 158 defines a second channel 162 that extends a length of the structural member 32*e*.

With continued reference to FIGS. 36-37, the top flange 40*e* extends generally inwardly in the shelving unit 10 and in a direction away from the middle portion 160. More particularly, the top flange 40*e* has an S-shaped configuration with an elevated portion 48*e* defining a top surface 50*e* and a lower portion 52*e* defining a lower surface 54*e*. A sidewall 56*e* transitions from the elevated portion 48*e* to the lower portion 52*e* to provide the S-shaped configuration. The lower portion 52*e* is configured to support a shelf with the sidewall 56*e* providing a stop for lateral movement of the shelf in an outward direction (i.e., toward the middle portion 160) in the shelving unit 10. In this regard, a pair of existing shelf support beams 14*e* positioned on the front and rear sides of the shelf captures a shelf between opposing sidewalls 56*e* to prevent unwanted lateral movement of the shelf. Generally, a height of the sidewall 56*e* (e.g., a distance between the lower surface 54*e* and the top surface 50*e*) may be approximately a thickness of a shelf. The shelf is then approximately flush with the top surface 50*e*. The top surface 50*e* may be a flat surface and generally planar or parallel with the lower surface 54*e* and the bottom flange 42*e*.

The bottom flange 42*e* also extends generally inwardly in the shelving unit 10 and in a direction away from the middle portion 160. The bottom flange 42*e* is configured to receive the one or more crossbeams 20, if used. In this regard, the bottom flange 42*e* includes one or more spaced apart apertures 60*e* (e.g., FIG. 30) configured to receive and secure an end of a corresponding crossbeam to the bottom flange 42*e*. The apertures 60*e* are oblong in shape and are spaced apart a desired distance along a length of the bottom flange 42*e*. For example, each horizontal shelf support beam 14*e* may have three apertures 60*e* spaced equally apart along a length of the beam 14*e* to support three corresponding crossbeams.

As best shown in FIGS. 36-37, the middle portion 160 joins the top flange 40*e* and the bottom flange 42*e* to define the C-shape of the structural member 32*e*. The middle portion 160 may be radiused at each of the locations at which the structural member 32*e* transitions to the top flange 40*e* and to the bottom flange 42*e*. In any event, the middle portion 160 includes a first web 164 and a second web 166 joined together by the embossed portion 158. In this regard, the embossed portion 158 includes a third web 168 joined to the first and second webs 164, 166 by a pair of sidewalls 170. More particularly, the first web 164 extends from the top flange 40*e* to one sidewall 170 and the second web 166 extends from the bottom flange 42*e* to the other one of the sidewalls 170. The sidewalls 170 extend outwardly from each of the first and second webs 164, 166 to the third web 168. To this end, the third web 168 and the sidewalls 170 collectively define the embossed portion 158.

The sidewalls 170 are angled generally outwardly from a shelving unit and in a direction away from the first channel 46*e*. In this regard, the embossed portion 158 projects outwardly from the middle portion 160 of the structural member 32*e* and, more particularly, outwardly relative to a plane 172 defined by the first and second webs 164, 166. As briefly described above, the embossed portion 158 defines a second channel 162 which extends a length of the structural member 32*e*. In this regard, the third web 168 is vertical and generally planar with the first and second webs 164, 166 and defines a base of the second channel 162. More particularly, the third web 168 is spaced outwardly a distance beyond the plane 172 defined by the first and second webs 164, 166. The distance that the third web 168 is spaced outwardly from the plane 172 defines a depth 174 of the second channel 162.

The embossed portion 158 may be generally trapezoidal in shape and the sidewalls 170 may be radiused at each of the locations at which the sidewalls 170 transition to the first, second, and third webs 164, 166, 168. The embossed portion 158 is located adjacent to the bottom flange 42*e* and in the lower half or lower two-thirds of the middle portion 160. Thus, a height of the second web 166 (e.g., a distance between the bottom flange 42*e* and the nearest sidewall 170) is smaller compared to a height of the first web 164 (e.g., a distance between the top flange 40*e* and the nearest sidewall 170). As described in further detail below, the securing finger 24*e* is located in the upper half or upper third of the middle portion 160 of the structural member 32*e*. The embossed portion 158 provides the shelf support beam 14*e* with a greater load carrying capacity compared to the shelf support beams 14-14*d* of the previously described embodiments.

With reference to FIGS. 28-35, the tabs 36*e* are an extension of the middle portion 160 at each end 28*e*, 30*e* of the shelf support beam 14*e*. In that regard, each tab 36*e* includes and end edge 72*e*, an upper edge 68*e*, and a lower edge 70*e*. Each tab 36*e* also includes the embossed portion 158 as described above. In addition to the embossed portion 158, each tab 36*e* also includes one securing finger 24*e* and an aperture 171 configured to receive a corresponding fastener 173 therethrough which may be used to create a positive connection between the support beam 14*e* and a corner post 12 of the shelving unit 10. As shown, the securing finger 24*e* is located on the part of the tab 36*e* that is an extension of the first web 164. Thus, the securing finger 24*e* is adjacent to the top flange 42*e*. In this regard, locating the securing finger 24*e* on the tab 36*e* adjacent to the top flange 40*e* (e.g., in the upper half or upper third of the tab 36*e*) provides the shelf support beam 14*e* with a greater load carrying capacity compared to the shelf support beams 14-14*d* of the previously described embodiments. To this end, the shelf support beam 14*e* of this embodiment, equipped with three crossbeams 20, may have a load bearing capacity of approximately 3,750 lbs., for example.

As shown in FIGS. 32-35, each securing finger 24*e* includes a stiffening rib 66*e* and extends generally inwardly in the shelving unit 10 and in a direction toward the channel 46*e*, similar to the above-described embodiments. Each securing finger 24*e* of this embodiment may also be punch-formed so as to be partially cut from the tab 36*e* and bent inwardly to form the shape of the securing finger 24*e*. Thus, the securing finger 24*e* may have a same thickness as the tab 36*e*. The securing finger 24*e* has a generally square shaped profile and includes a base edge 74*e*, a top edge 76*e*, a distal edge 78*e*, an outer surface 80*e*, and an inner surface 82*e*. The inner and outer surfaces 82*e*, 80*e* are curved such that the securing finger 24*e* has an S-shaped cross-section. The securing finger 24*e* projects from a bend line 84*e* on the tab 36*e* to the distal edge 78*e* which is spaced a distance away from the tab 36*e*.

The securing finger 24*e* of this embodiment also includes a stiffening rib, or stiffener 66*e*, that is formed during the punch-forming of the securing finger 24*e*. More particularly, the same punch is used to form both the securing finger 24*e* and the stiffener 66*e* at the same time. The stiffener 66*e* is configured to strengthen or stiffen the securing finger 24*e* against out of plane deformation when the support beam 14*e* is under load, particularly along the bend line 84*e* of the securing finger 24*e*. The stiffener 66*e* is formed so as to arcuately extend from the tab 36*e* a distance along the outer surface 82*e* of the respective securing finger 24*e*. Each stiffener 66*e* includes a raised spine 90*e* that defines a generally flat surface and a pair of radiused sidewalls 92*e* that extend between the spine 90*e* and surfaces of the securing finger 24*e* and the tab 36*e*. As shown, each spine 90*e* arcuately extends from a first terminal end on the tab 36*e* to a second terminal end on the securing finger 24*e*. More particularly, each stiffener 66*e* extends across the bend line 84*e* in a generally perpendicular manner such that a height of each stiffener 66*e* is generally greatest in a region where the stiffener 66*e* passes over the bend line 84*e*.

Forming of each securing finger 24*e* results in a square shaped aperture 86*e* being formed in the tab 36*e* beneath the curved inner surface 82*e* of the finger 24*e*. To this end, the space between the curved inner surface 82*e* of the finger 24*e* and the aperture 86*e* of the tab 36*e* defines a pocket 88*e*. The pocket 88*e* may be generally V-shaped. As described in further detail below, when the shelf support beam 14*e*, and more particularly the securing finger 24*e*, is engaged with the corner post 12*a*, the pocket 88*e* is configured to receive a portion of the corner post 12*a* therein.

Figure 34:
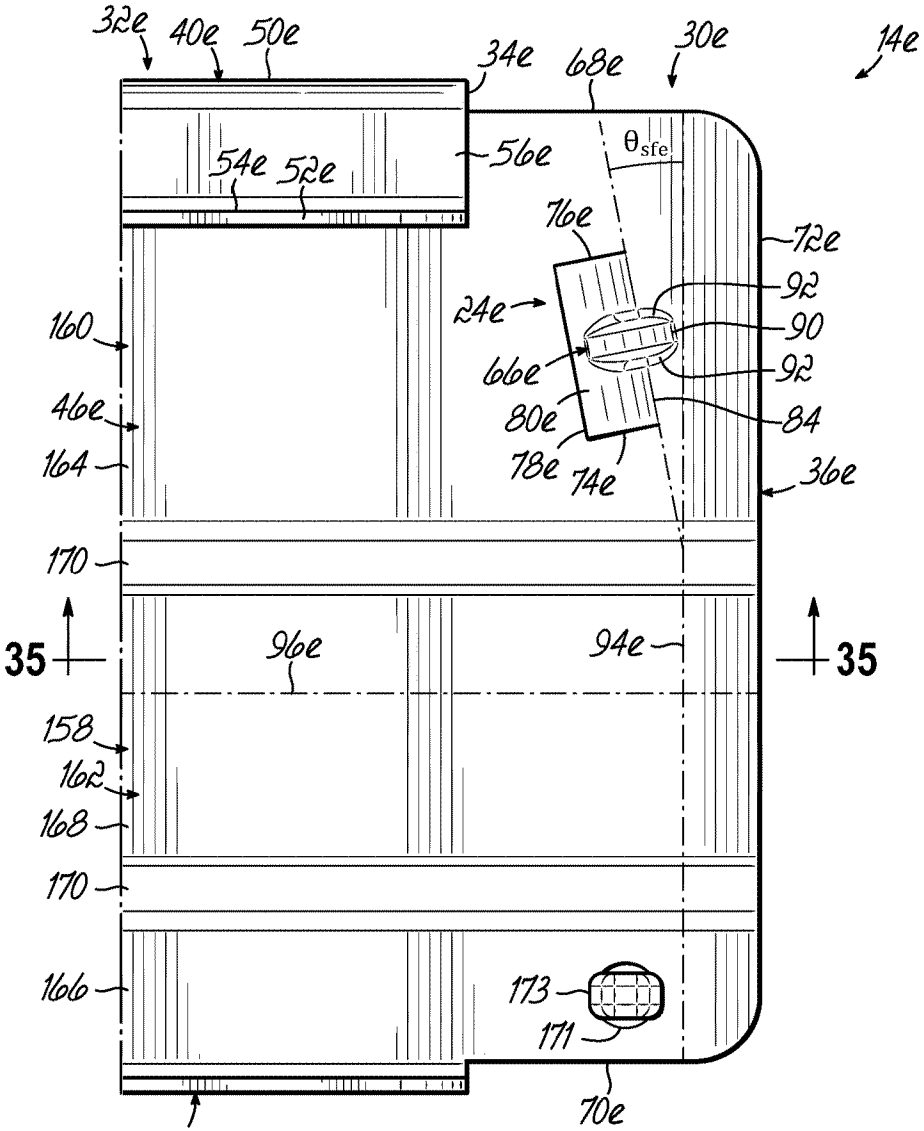
FIG. 34 is plan view of the back side of the second end of the shelf support beam of FIGS. 28-33.

As best shown in FIG. 34, the bend line 84*e* of the securing finger 24*e* is angled relative to a plane axis 94*e* disposed perpendicular to the longitudinal axis 96*e* of the shelf support beam 14*e* such that the entirety of the securing finger 24*e* is angled inwardly toward a center of the structural member 32*e*. In this regard, the top edge 76*e* of the securing finger 24*e* is positioned closer to the structural member 32*e* compared to the base edge 74*e* of the securing finger 32*e*. The angled relationship between the bend line 84*e* and the axis 94*e* defines a securing finger angle $\theta_{ste}$. In this regard, the securing finger angle $\theta_{ste}$ may be within a range of between 5° to 30°, for example. Preferably, the angle $\theta_{ste}$ is within a range of between 10° to 20° and, in the embodiment shown, the securing finger angle $\theta_{ste}$ is 11° for each securing finger 24*e*.

Figure 38:
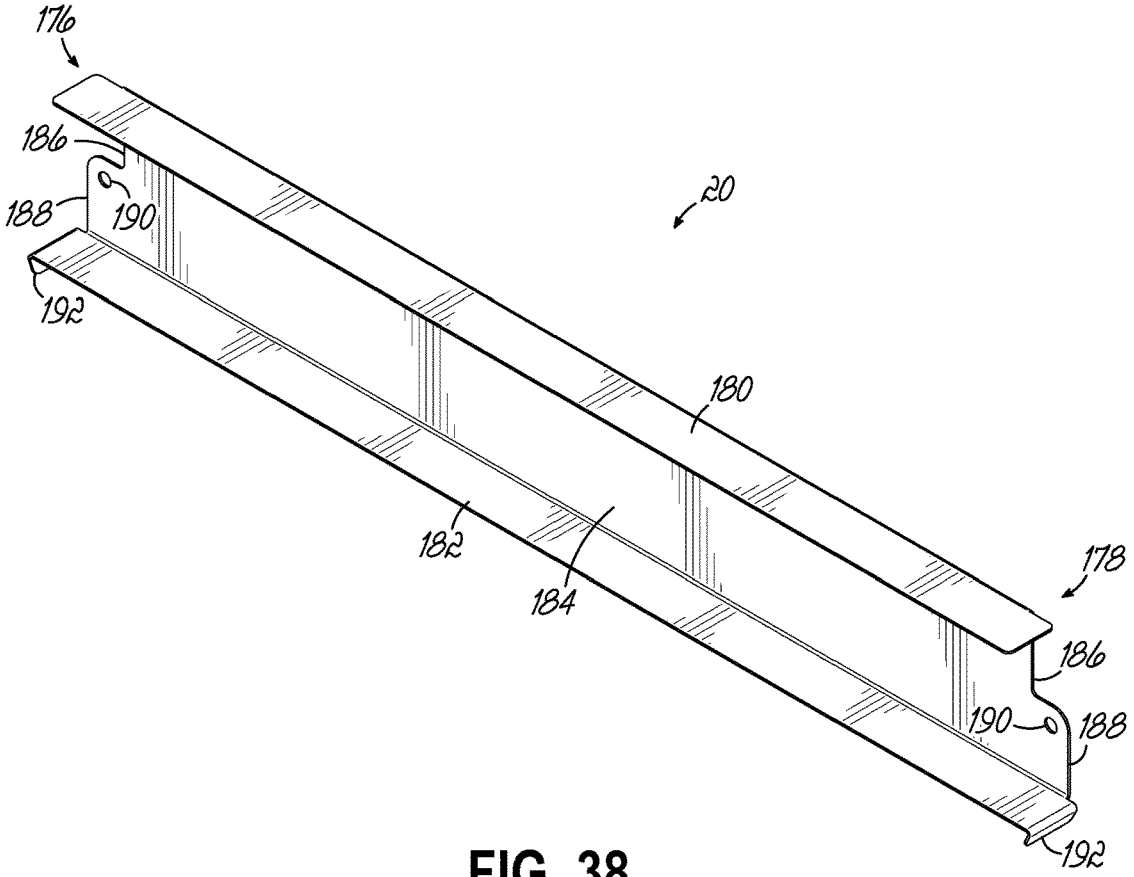
FIG. 38 is a side view of a crossbeam.
Figure 39:
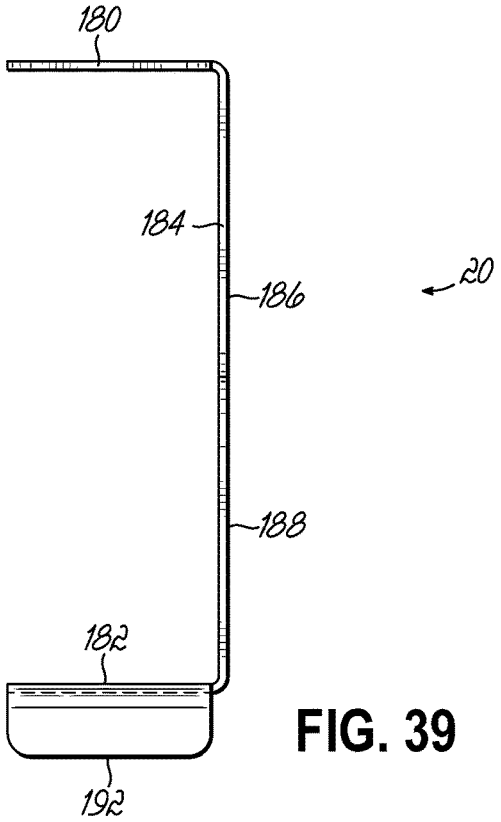
FIG. 39 is an end view of the crossbeam of FIG. 38.

With reference to FIG. 38-39, details of one crossbeam 20 are shown and will now be described. In this regard, the crossbeam 20 includes a first end 176 and a second end 178 located at opposite longitudinal ends of the crossbeam 20 between which a C-shaped body of the crossbeam 20 extends.

The C-shaped body of the crossbeam 20 includes an upper flange 180 and a lower flange 182 between which a middle portion 184 of the body of the crossbeam 20 extends. The middle portion 184 of the crossbeam 20 may be step-shaped at each of the first and second ends 176, 178 of the crossbeam 20. The step-shaped configuration of the middle portion 184 defines a notch 186 and a foot portion 188 near each of the first and second ends 176, 178 of the crossbeam 20. Each notch 186 is adjacent to the upper flange 180 and each foot 188 is adjacent to the lower flange 182. Each foot portion 188 may include a bore 190 therethrough. The upper flange 180 and the lower flange 182 are generally planar and extend a length of the crossbeam 20 (e.g., a distance between the first and second ends 176, 178 of the crossbeam 20).

The crossbeam 20 is configured to span a distance between a corresponding pair of shelf support beams 14 that generally corresponds to a width of the supported shelf 22 (e.g., FIG. 1). In this regard, the upper flange 180 is configured to engage with the top flange 40 of each corresponding shelf support beam 14 and the lower flange 182 of the crossbeam 20 is configured to engage with the bottom flange 42 of each corresponding shelf support beam 14. As best shown in FIG. 1, the top flange 40 of each shelf support beam 14 extends through corresponding notches 186 at each end of the crossbeam 20 such that the upper flange 180 of the crossbeam 20 engages with and is supported by the lower portion 52 of the top flange 40 of each corresponding shelf support beam 14.

With reference to FIGS. 38-39, the lower flange 182 of the crossbeam 20 includes downward-facing tabs 192 at each of the first and second ends 176, 178 of the crossbeam 20. In this regard, the tabs 192 extend from opposite ends of the lower flange 182 and may be bent, in a downward direction from horizontal, 90° or more, such as between 90° and 130°, for example. The tabs 192 are sized to fit into corresponding oblong apertures 60 formed in the bottom flange 42 of a pair of shelf support beam 14, as shown in FIG. 1. To this end, when coupled between the pair of shelf support beams 14, the lower flange 182 of the crossbeam 20 is supported on the bottom flange 42 of each of the shelf support beams 14.

Figure 40:
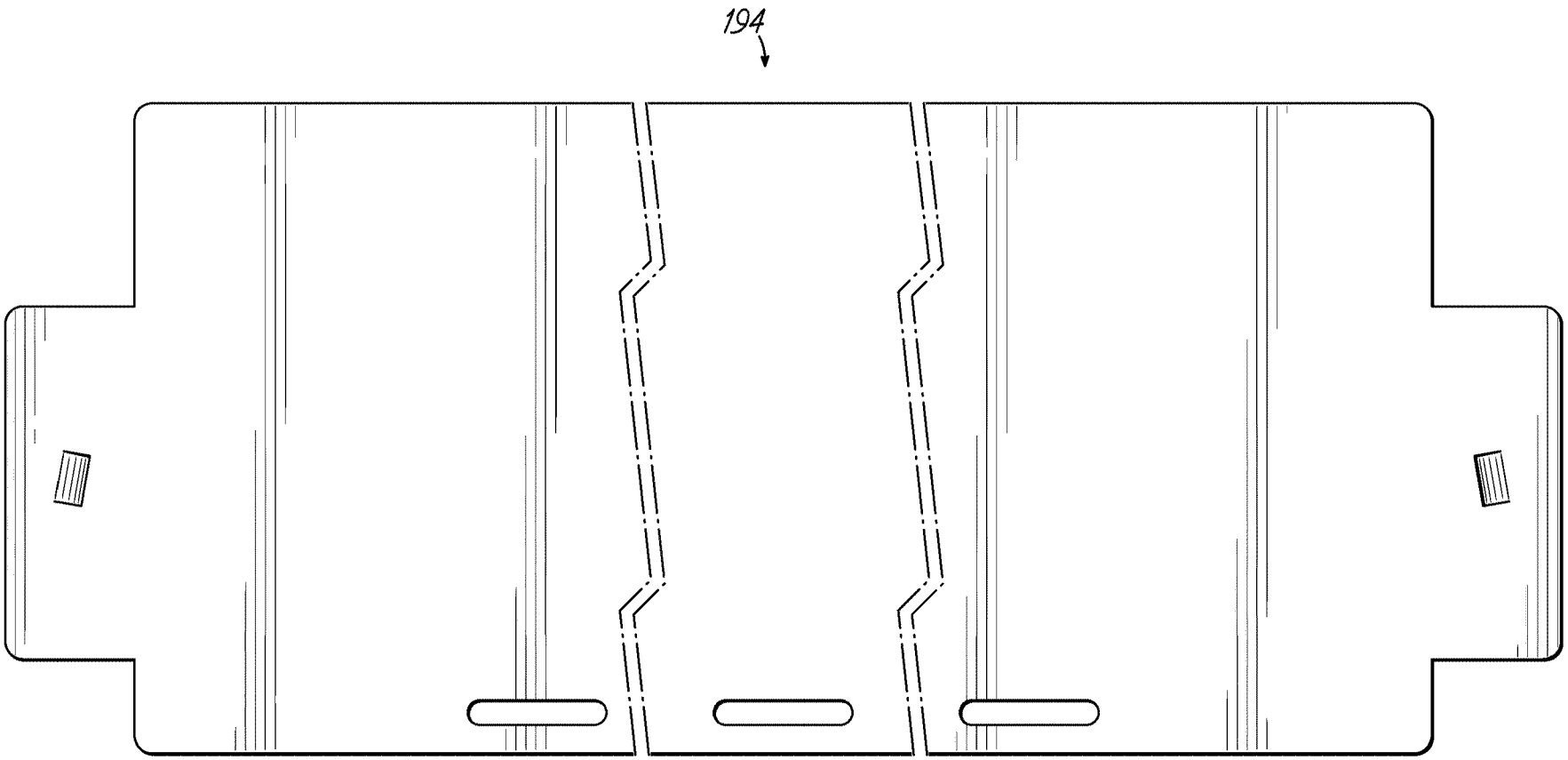
FIG. 40 is a top view of a blank used to form a beam according to one embodiment of the invention.

With reference to FIG. 40, an exemplary method of manufacturing any one of the shelf support beams described herein will now be described. In this regard, a blank 194 is provided that is cut from a sheet of material. The blank 194 is cut to the desired shape of the exemplary shelf support beam to be formed and is illustrated in a flat and unformed state. To form the shelf support beam from the blank 194, each securing finger is first punch-formed in the respective tabs at either end of the blank 194. Any other apertures are also punch-formed in the blank 194 at this time. Once each securing finger is formed in each tab, the blank 194 is fed into a roll-forming machine where the blank 194 is formed into a finished shelf support beam, such as the shelf support beam 14*b* described above with respect to FIGS. 16-17. The roll forming machine is fit with grooved rolls to accommodate for the punch-formed securing fingers during the rolling process. That way, the configuration of the fingers is not changed in any way during the roll forming process.

Figure 41:
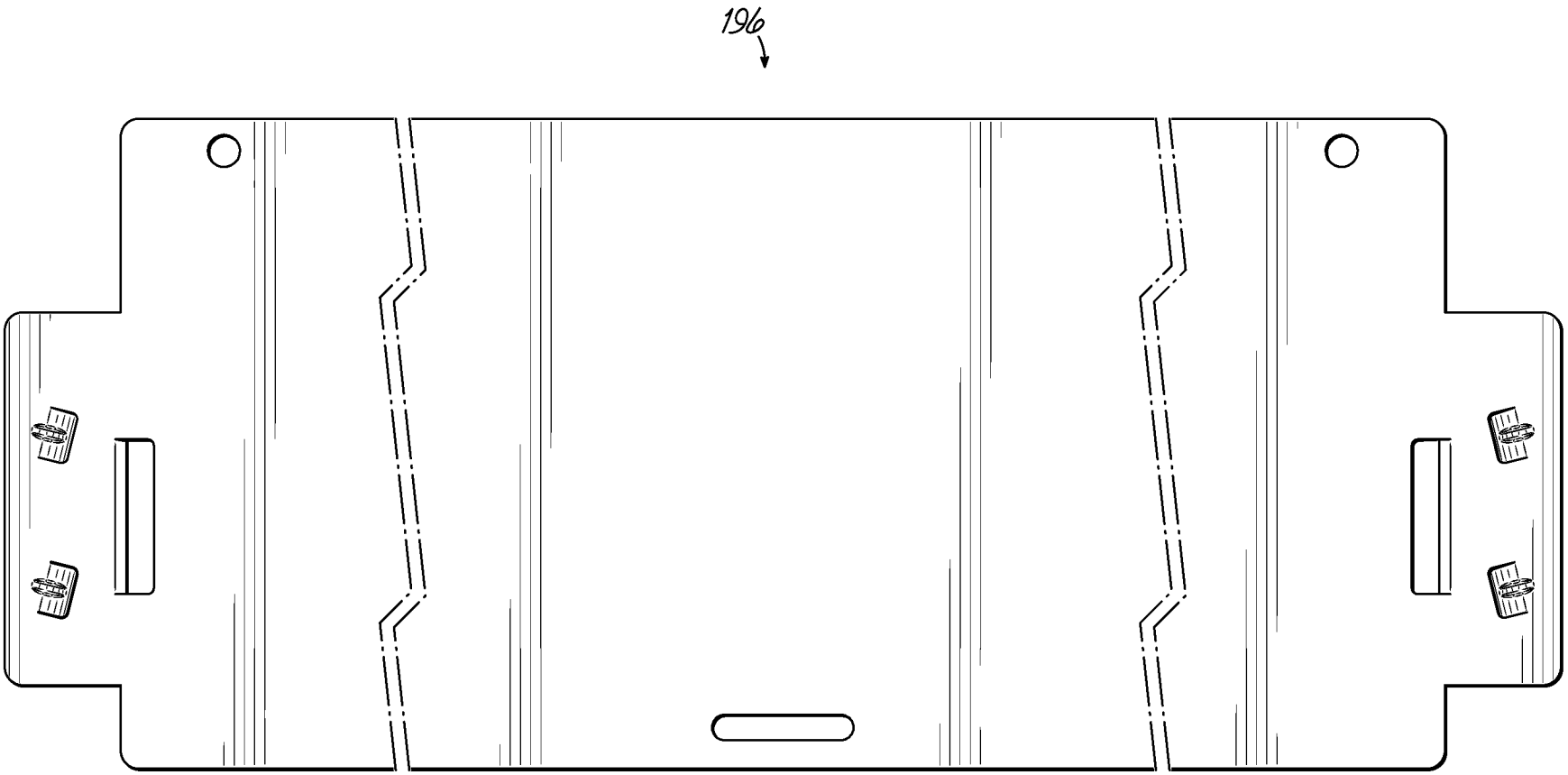
FIG. 41 is a top view of a blank used to form a beam according to another embodiment of the invention.

FIG. 41 illustrates a blank 196 to be formed into a finished shelf support beam having enforcement tabs, such as the shelf support beam 14 described above with respect to FIGS. 1-12. To form the shelf support beam from the blank 196, each pair of securing fingers and enforcement tab is first punch-formed in the respective tabs at either end of the blank 196. Any other apertures are also punch-formed in the blank 196 at this time. The punched blank 196 is then fed into a roll forming machine that is fit with one or more grooved rolls to accommodate for the punch-formed securing fingers and enforcement tabs during the rolling process. That way, the configuration of the fingers and enforcement tabs is not changed in any way during the roll forming process.

While the present invention has been illustrated by the description of various embodiments thereof, and while the embodiments have been described in considerable detail, it is not intended to restrict or in any way limit the scope of the appended claims to such detail. Thus, the various features discussed herein may be used alone or in any combination. Additional advantages and modifications will readily appear to those skilled in the art. The invention in its broader aspects is therefore not limited to the specific details and illustrative examples shown and described. Accordingly, departures may be made from such details without departing from the scope of the general inventive concept.

What is claimed is:

1. A shelf support beam for use in a shelving unit to support a shelf comprising:

a first end and a second end located at opposite longitudinal ends of the shelf support beam between which a structural member extends, the structural member having a C-shaped cross-section and including a web separating a top flange that is configured to support the shelf from a bottom flange;

a tab located at each of the first and second ends of the structural member, each tab having a pair of securing fingers formed therein; and an enforcement tab formed in the web at each of the first and second ends of the structural member;

wherein each securing finger is angled inwardly toward the enforcement tab relative to a plane disposed perpendicular to a longitudinal axis of the shelf support beam to define a securing finger angle for each securing finger.

2. The shelf support beam of claim 1, wherein each securing finger includes a stiffening rib.

3. The shelf support beam of claim 2, wherein each stiffening rib arcuately extends from a first terminal end on the tab to a second terminal end on the securing finger.

4. The shelf support beam of claim 2, wherein each securing finger and stiffening rib are punch-formed.

5. The shelf support beam of claim 1, wherein the securing finger angle for each securing finger is within a range of between 10° to 20°.

6. The shelf support beam of claim 1, wherein the top flange and the bottom flange are truncated at each of the first and second ends of the shelf support beam to define abutment edges.

7. The shelf support beam of claim 6, wherein each tab is an extension of the web and extends at a distance beyond the abutment edges the first and second ends of the shelf support beam.

8. The shelf support beam of claim 6, wherein each enforcement tab includes an outer surface that is coplanar with the abutment edges at each of the first and second ends of the shelf support beam.

9. The shelf support beam of claim 1, wherein each enforcement tab terminates at a base edge and a top edge, the base edge being located opposite a first one of the pair of securing fingers and the top edge being located opposite a second one of the pair of securing fingers.

10. The shelf support beam of claim 1, wherein each enforcement tab defines an elongate length between a base edge and a top edge, the elongate length of each enforcement tab being less than a distance of the pair of securing fingers are spaced apart.

11. A shelving unit comprising:

a plurality of posts;

a plurality of shelves; and a plurality of shelf support beams each being configured to be attached to two posts of the plurality of posts to support one of the plurality of shelves, each shelf support beam comprising:

a first end and a second end located at opposite longitudinal ends of the shelf support beam between which a structural member extends, the structural member having a C-shaped cross-section and including a web separating a top flange that is configured to support one of the plurality of shelves from a bottom flange;

a tab located at each of the first and second ends of the structural member, each tab having a pair of securing fingers formed therein; and an enforcement tab formed in the web at each of the first and second ends of the structural member;

wherein each securing finger is angled inwardly toward the enforcement tab relative to a plane disposed perpendicular to a longitudinal axis of the shelf support beam to define a securing finger angle for each securing finger.

12. The shelf support beam of claim 11, wherein each securing finger includes a stiffening rib.

13. The shelf support beam of claim 12, wherein each stiffening rib arcuately extends from a first terminal end on the tab to a second terminal end on the securing finger.

14. The shelf support beam of claim 12, wherein each securing finger and stiffening rib are punch-formed.

15. The shelf support beam of claim 11, wherein the securing finger angle for each securing finger is within a range of between 10° to 20°.

16. The shelf support beam of claim 11, wherein the top flange and the bottom flange are truncated at each of the first and second ends of the shelf support beam to define abutment edges.

17. The shelf support beam of claim 16, wherein each enforcement tab includes an outer surface that is coplanar with the abutment edges at each of the first and second ends of the shelf support beam.

18. The shelf support beam of claim 11, wherein the top flange includes an elevated portion and a shelf support portion separated by a sidewall and having a S-shaped configuration with the shelf support portion being configured to support the shelf and the sidewall being configured to prevent lateral motion of the shelf toward the web.

19. The shelving unit of claim 11, wherein each of the plurality of posts include pairs of keyholes distributed along a length of the post, each keyhole being configured to receive a respective one of the pair of securing fingers therein for securing the shelf support beam to a respective post, each keyhole comprising:

a V-shaped portion that transitions to a rectangular-shaped portion, the V-shaped portion having a vertical edge and a step-shaped angled edge that extends from the V-shaped portion to the rectangular-shaped portion;

wherein the angled edge has an angular relationship relative to the vertical edge that defines a keyhole angle.

20. The shelving unit of claim 19, wherein the keyhole angle for each keyhole is within a range of between 10° to 20°.

* * * * *